US010842276B2

(12) United States Patent
Sugano et al.

(10) Patent No.: US 10,842,276 B2
(45) Date of Patent: Nov. 24, 2020

(54) CHAIR AND COVER MEMBER OF THE CHAIR

(71) Applicant: KOKUYO CO., LTD., Osaka (JP)

(72) Inventors: Takao Sugano, Osaka (JP); Toshiki Yajima, Osaka (JP); Fei Xu, Osaka (JP); Yasuhiro Shibamoto, Osaka (JP); Yojiro Kinoshita, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 0 days.

(21) Appl. No.: 16/464,895

(22) PCT Filed: Dec. 20, 2016

(86) PCT No.: PCT/JP2016/088003

§ 371 (c)(1),
(2) Date: May 29, 2019

(87) PCT Pub. No.: WO2018/116386

PCT Pub. Date: Jun. 28, 2018

(65) Prior Publication Data

US 2019/0281986 A1 Sep. 19, 2019

(51) Int. Cl.
*A47C 3/025* (2006.01)
*A47C 3/026* (2006.01)
(Continued)

(52) U.S. Cl.
CPC ..... *A47C 3/026* (2013.01); *A47C 3/027* (2013.01); *A47C 7/004* (2013.01); *A47C 7/144* (2018.08)

(58) Field of Classification Search
CPC ..... A47C 3/026; A47C 3/027; A47C 7/004; A47C 7/144; A47C 7/441
(Continued)

(56) References Cited

U.S. PATENT DOCUMENTS 4,555,085 A * 11/1985 Bauer ..... A47C 3/026 297/302.4 X
4,575,151 A * 3/1986 Edstrom ..... A47C 3/026 297/302.6
(Continued)

FOREIGN PATENT DOCUMENTS

CA 3044190 A1 * 6/2018 ..... A47C 3/026
DE 102010016989 A1 11/2011
(Continued)

OTHER PUBLICATIONS

International Search Report dated Apr. 4, 2017, issued in counterpart International Application No. PCT/JP2016/088003 (2 pages).
(Continued)

*Primary Examiner* — Rodney B White
(74) *Attorney, Agent, or Firm* — Westerman, Hattori, Daniels & Adrian, LLP

(57) ABSTRACT

A chair according to the present invention includes: a leg 1; a leg support pole 13; a support base 4; a movement mechanism 5 located below a seat 2, the movement mechanism 5 provided with plural movement parts 5A, 5B configured to allow the seat 2 to move in a certain area along a predetermined trajectory in a front-rear and left-right directions between the support base 4 and the seat 2, the movement mechanism 5 being a support mechanism configured to support the seat 2 so that the seat 2 moves in the front-rear direction and left-right directions; and plural cover members 71, 72 arranged corresponding to the plural movement parts 5A, 5B. The plural cover members 71, 72 are configured to move relatively in accordance with movement of the plural movement parts 5A, 5B and cover the support mechanism 5.

6 Claims, 20 Drawing Sheets

(51) Int. Cl.
*A47C 7/14* (2006.01)
*A47C 3/027* (2006.01)
*A47C 7/00* (2006.01)

(58) Field of Classification Search
USPC ..... 297/302.2, 314, 325
See application file for complete search history.

(56) References Cited

U.S. PATENT DOCUMENTS 4,664,352 A * 5/1987 Shibuki ..... B60N 2/502 297/302.2 X
5,035,466 A * 7/1991 Mathews ..... A47C 1/023 297/337
5,397,163 A 3/1995 Puerner
5,951,109 A * 9/1999 Roslund, Jr. ..... A47C 1/03255 297/301.4 X
6,523,897 B2 * 2/2003 Pan ..... A47C 1/022 297/325 X
6,685,268 B2 * 2/2004 Meyer ..... A47C 7/448 297/314 X
6,688,689 B1 * 2/2004 Thorn ..... A47C 3/0252 297/325 X
6,979,059 B1 * 12/2005 Conlin ..... A47C 3/026 297/314 X
7,100,983 B1 * 9/2006 Gant ..... A47C 3/025 297/314 X
8,029,060 B2 * 10/2011 Parker ..... A47C 1/023 297/314 X
8,439,442 B2 * 5/2013 Highlander ..... A47C 7/14 297/314 X
8,857,909 B2 * 10/2014 Bock ..... A47C 3/026 297/302.2
10,058,180 B2 * 8/2018 Desanta ..... A47C 7/448
2005/0264068 A1 12/2005 Bodinek
2007/0040433 A1 * 2/2007 Huang ..... A47C 1/03238 297/325
2009/0278388 A1 * 11/2009 Reingewirtz ..... A47C 3/025 297/314 X
2012/0256458 A1 * 10/2012 Gehner ..... A47C 7/443 297/314
2018/0279785 A1 * 10/2018 Moreschi ..... A47C 1/03272
2019/0045928 A1 * 2/2019 Yajima ..... A47C 1/024
2019/0208910 A1 * 7/2019 Sugano ..... A47C 3/18
2019/0343286 A1 * 11/2019 Sugano ..... A47C 3/027

FOREIGN PATENT DOCUMENTS

DE 102014013560 A1 3/2016
EP 2387913 A1 11/2011
EP 2862482 B1 * 5/2016 ..... A47C 3/22
JP 3-33646 U 4/1991
JP 7-213372 A 8/1995
JP 8-383 A 1/1996
JP 2003-38283 A 2/2003
JP 2011-156052 A 8/2011
JP 2011-167342 A 9/2011
JP 5187738 B2 4/2013
WO 00/24295 A1 5/2000

OTHER PUBLICATIONS

Extended (Supplementary) European Search Report dated Jul. 13, 2020, issued in counterpart EP Application No. 16924723.6 (7 pages).
Office Action dated Apr. 7, 2020, issued in counterpart JP Application No. 2018-557277, with English Translation. (5 pages).

* cited by examiner

CHAIR AND COVER MEMBER OF THE CHAIR

TECHNICAL FIELD

The present invention relates to a chair suitable for office use or the like and a cover member of the chair.

BACKGROUND ART

Many chairs such as swivel chairs for office use, which are intended for a sitting person to maintain a comfortable sitting posture for a long time in an office, at home, or the like have been conventionally proposed (for example, see Patent Document 1).

Each of the swivel chairs for office use is configured to move a seat or a backrest in accordance with mainly backward or forward tilting of a sitting person such that the sitting person can comfortably act while doing work.

Some of the office chairs have been proposed as chairs each provided with a cover member for covering a mechanism for acting as the movement of the seat or the backrest and to cover the mechanism—the seat for the purpose of effectively avoiding a user's body, clothes, or the like from touching the mechanism during the movement of the seat or the backrest. Such a chair can not only avoid a problem that a sitting person may touch the mechanism, but also apparently cover the mechanism and have an outline matching a preference of a consumer as a user. In addition, it is can be realized that the chair enables the sitting person to feel comfortable, and the chair can apparently look smart and satisfy a preference of the sitting person.

CITATION LIST

Patent Literature

Patent Document 1: Japanese Patent No. 5187738

SUMMARY OF THE INVENTION

Problem to be Solved by the Invention

Currently, for the purpose of further improving sitting comfort of a sitting person compared to a conventional chair, a chair configured to perform various movements of a seat or a backrest has been proposed. In the chair configured as just described, it is conceivable that the outline of a movement mechanism configured to movably support the seat or the backrest also largely changes in accordance with the movement of the seat or the backrest.

However, if a cover member prevents a sitting person from touching the movement mechanism from the outside, the shape of the cover member needs to be set in consideration of all movement trajectories of the movement function. Accordingly, the more various the movement of the seat or the backrest is, the larger the outline of the cover member becomes. Therefore, a possibility of an interference of the cover itself with the leg of the sitting person may increase, and in addition, the appearance of the chair may not apparently match a consumer's preference.

The present invention is thus intended to solve the above problems, and also to provide a chair and a cover member of the chair that avoid contact of a sitting person with a movement mechanism moving below a seat at the time of movement of the seat or a backrest and that can desirably maintain the appearance of the chair while inhibiting an interference of the movement mechanism with the leg of the sitting person.

Means for Solving the Problem

The following means are taken in the present invention to achieve the object.

In other words, a chair according to the present invention includes: a leg arranged on a floor surface; a leg support pole provided to stand from the leg; a support base provided on an upper end of the leg support pole; a movement mechanism located below a seat, the movement mechanism including a plurality of movement parts configured to allow the seat to move in a certain area along a predetermined trajectory in a front-rear and left-right directions between the support base and the seat, the movement mechanism being a support mechanism to support the seat so that the seat moves in the front-rear direction and left-right directions; and a plurality of cover members arranged corresponding to the plurality of movement parts. The plurality of cover members is configured to move relatively in accordance with movement of the plurality of movement parts and cover the support mechanism.

With this configuration, the movement mechanism configured to move a backrest or the seat includes the plural movement parts, and thus an entire movement range including the respective movement trajectories is increased. Even in such a case, with the configuration described above, the plural cover members are moved relatively in accordance with the movement of the plural movement parts. Consequently, the respective cover members can be compactly configured and can surely cover the movement parts to hide the movement parts. In addition, a sitting person can be prevented from interfering with the movement mechanism and the appearance can be preferably maintained. In particular, the movement mechanism not only moves the seat but also supports the seat. Accordingly, the cover members are attached to the movement mechanism and thereby the seat support portion can be covered concurrently.

In order that a configuration not interfering with the movement mechanism while the cover members are compactly configured is realized, it is desirable that the plural cover members to cover the movement mechanism is a configured by combination of a member moving in one direction and a member moving in another direction orthogonal to the one direction. Thus, in the movement mechanism configured to move the seat in a two-dimensional surface, the plural cover members are combined to move relatively in two directions perpendicular to each other. In such a case, the configuration substantially not interfering with the movement mechanism can be easily realized without extreme increase of the cover members in size.

In order to appropriately prevent foreign objects from entering into a gap between the cover members while the cover members are compactly configured, it is desirable that the movement mechanism includes a left-right support part to support the seat movably in the left-right direction, and a front-rear support part to support the seat movably in the front-rear direction, that the plural cover members include a left-right cover member attached to the left-right support part, and a front-rear cover member attached to the front-rear support part, and that the left-right cover member and the front-rear cover member are configured to move relatively while coming close to each other with the gap between the cover members. In other words, the movement mechanism includes the front-rear support part and the left-right support part, and the left-right cover member is attached to the left-right support part and the front-rear cover member is attached to the front-rear support part. Thus, the cover members are compactly configured and more applicable to the movement parts. In addition, only gaps are secured between the cover members in the front-rear direction and the left-right direction; therefore, the cover members can be prevented from interfering with the movement mechanism. The gaps with appropriate dimensions can appropriately prevent foreign objects from entering the gaps between the cover members.

In addition, the chair includes: the leg arranged on the floor surface; the leg support pole provided to stand from the leg; the support base provided on the upper end of the leg support pole; the left-right support part attached to the support base; a front-rear support part attached to the left-right support part; and the seat provided above the front-rear support part. In such a case, to more appropriately prevent foreign objects from entering the gap between the cover members, it is desirable that the front-rear cover member is provided above the left-right cover member, and the chair further includes an interpolation cover member interposed between the left-right cover member and the front-rear cover member. In other words, at the time of moving the seat and the backrest in the front-rear direction and the left-right direction, the amount of movement or tilt in the front-rear direction is larger than those in the left-right direction. Therefore, the front-rear support part is provided above the left-right support part, and the front-rear cover member is provided above the left-right cover member. Consequently, a stable two-story structure can be established, and the front-rear cover member relatively increasing in size can be arranged as close to a lower surface of the seat as possible. In addition, the interpolation cover member is provided and thereby even when a gap between the left-right cover member and the front-rear cover member varies, the gap is easily closed.

Further, on a facing surface where the left-right movement member is disposed adjacent to the front-rear movement member, an opening for inserting a connection member to relatively and movably connect the left-right movement part to the front-rear movement part is disposed. With the configuration, the left-right movement mechanism on the lower side and the front-rear movement mechanism on the upper side can be connected in the opening by the connection member. In addition, the left-right cover member and the front-rear cover member can be appropriately prevented from interfering with the connection member.

Furthermore, in accordance with the relative movement between the left-right cover member and the front-rear cover member, the interpolation cover member may relatively move in a different direction from the movement of the left-right cover member and the front-rear cover member. With such a configuration, even when the left-right cover member and the front-rear cover member move in different directions and thus a gap therebetween varies in a complicated manner, the gap can be appropriately closed by the interpolation cover member.

In order that functions of the plural cover members can be appropriately assigned and the movement mechanism can be suitably covered, it is desirable that a fixation cover member configured to cover the support base and not to move in accordance with the movement of the seat is further provided. In other words, when, instead of excluding the fixation cover, the support base or the like not movable in the front-rear direction and the left-right direction is configured to be covered by the fixation cover member, i.e., when the movable cover member and the fixation cover member are both applied, the functions of the respective cover members can be appropriately assigned.

Also, the cover member according to the present invention configures the foregoing chair. The cover members as just described are only prepared and thereby the safety of the chair can be secured, and the preferable appearance thereof can be effectively realized.

Effect of the Invention

The present invention described above provides the chair and the cover of the chair that avoid contact of the sitting person with a movement mechanism moving at below the seat at the time of movement of the seat or the backrest and that can desirably maintain the appearance of the chair while inhibiting an interference of the movement mechanism with the leg of the sitting person.

MODE FOR CARRYING OUT THE INVENTION

First Embodiment

Herein, a first embodiment of the present invention will be described with reference to the drawings.

Figure 1:
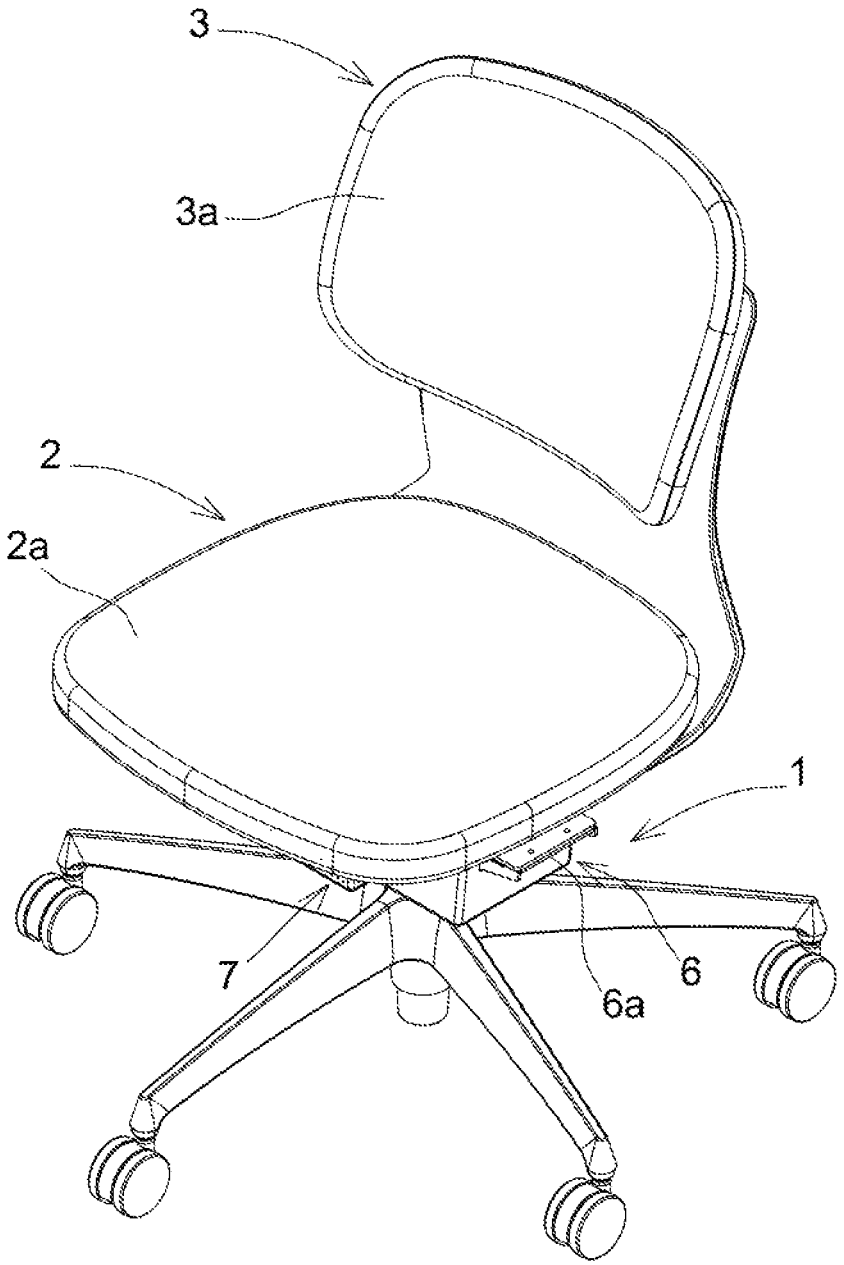
FIG. 1 is a perspective view of a chair according to a first embodiment of the present invention.
Figure 2:
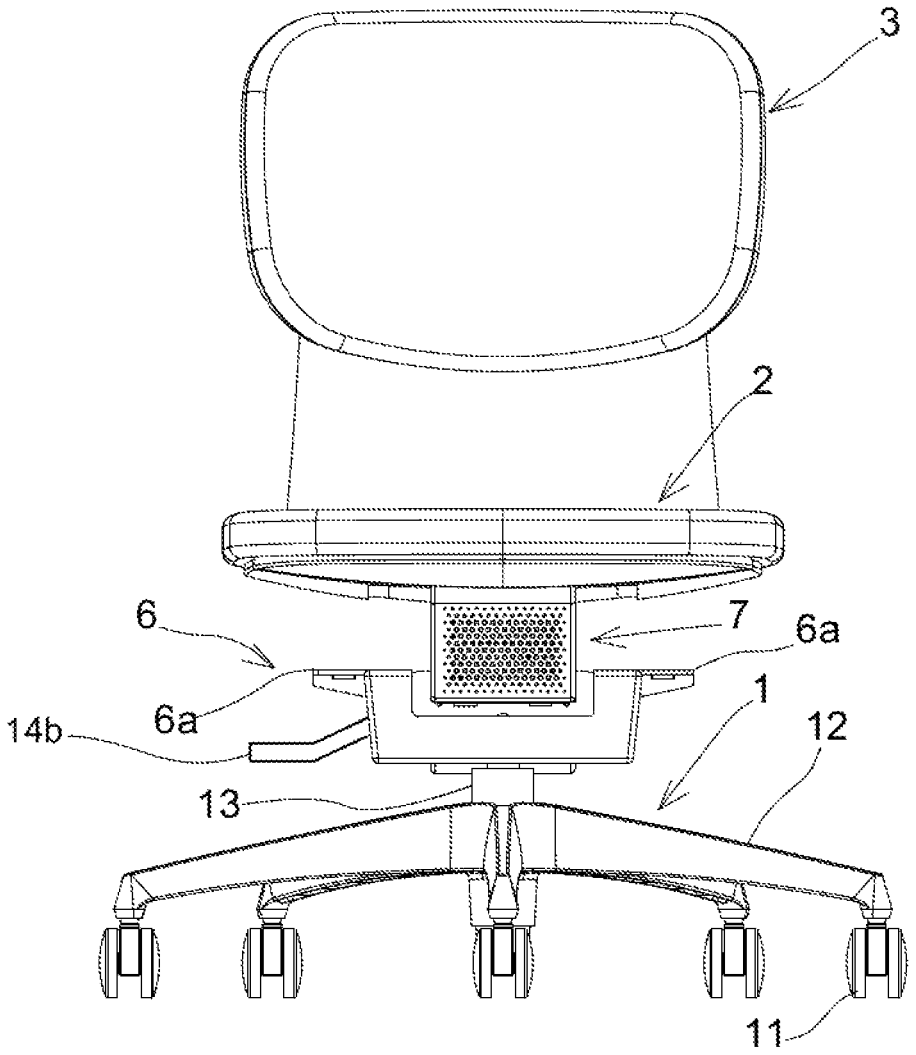
FIG. 2 is a front view of the chair according to the first embodiment of the present invention.
Figure 3:
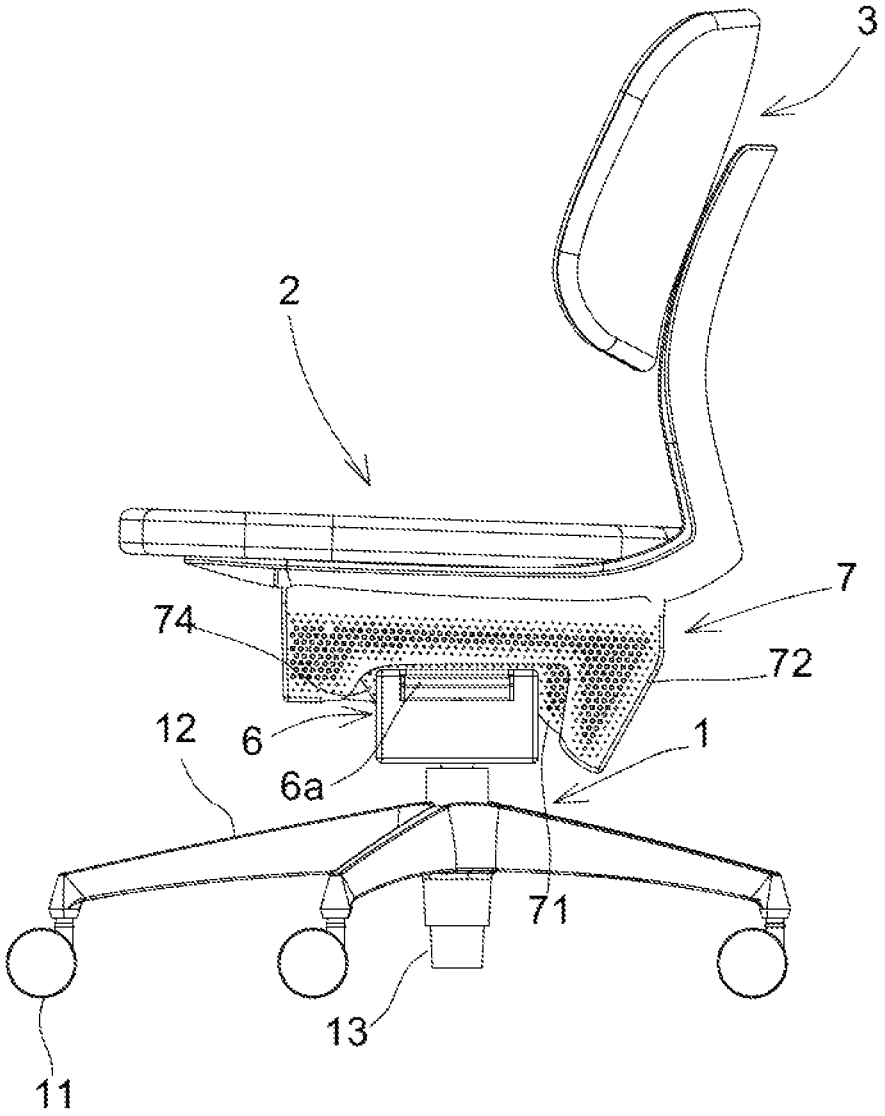
FIG. 3 is a right-side view of the chair according to the first embodiment of the present invention.
Figure 4:
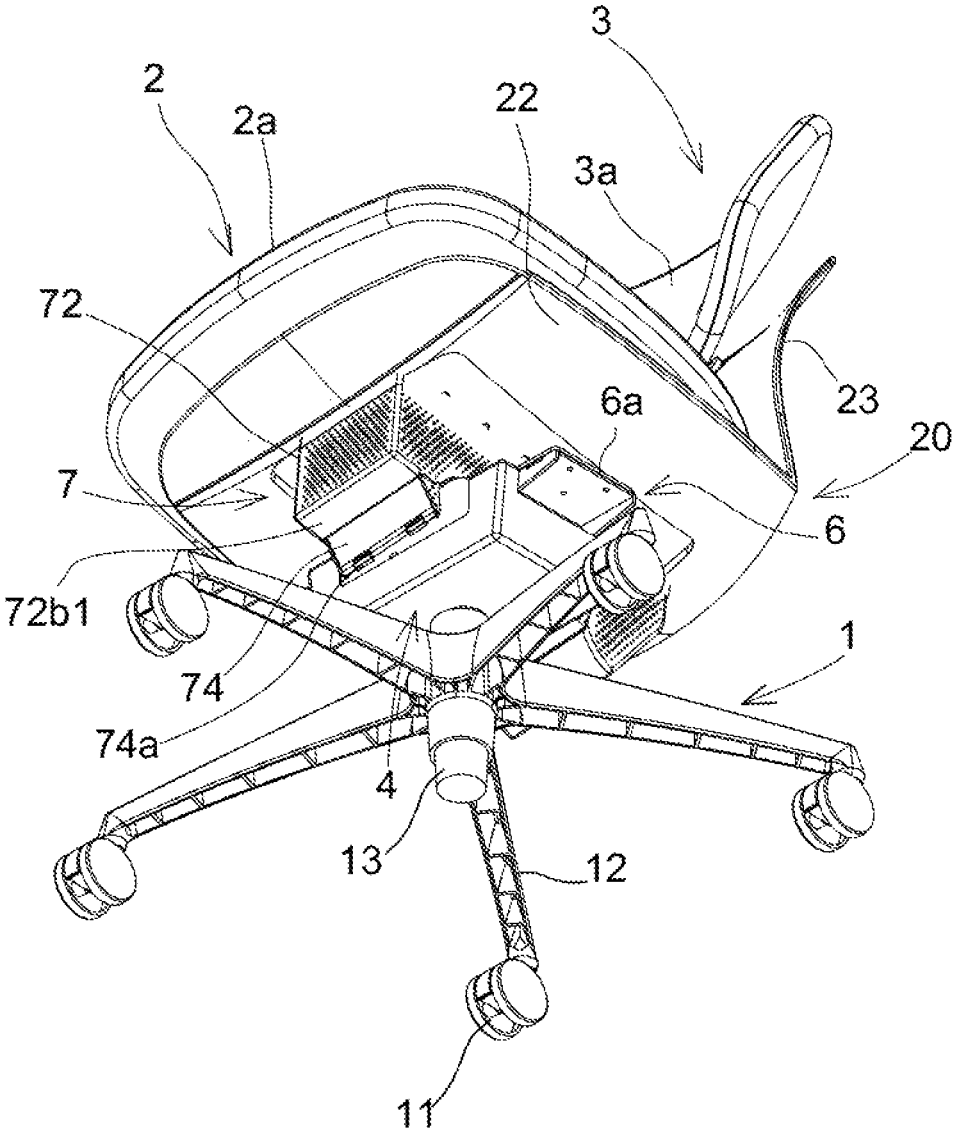
FIG. 4 is a lower perspective view of the chair according to the first embodiment of the present invention.
Figure 5:
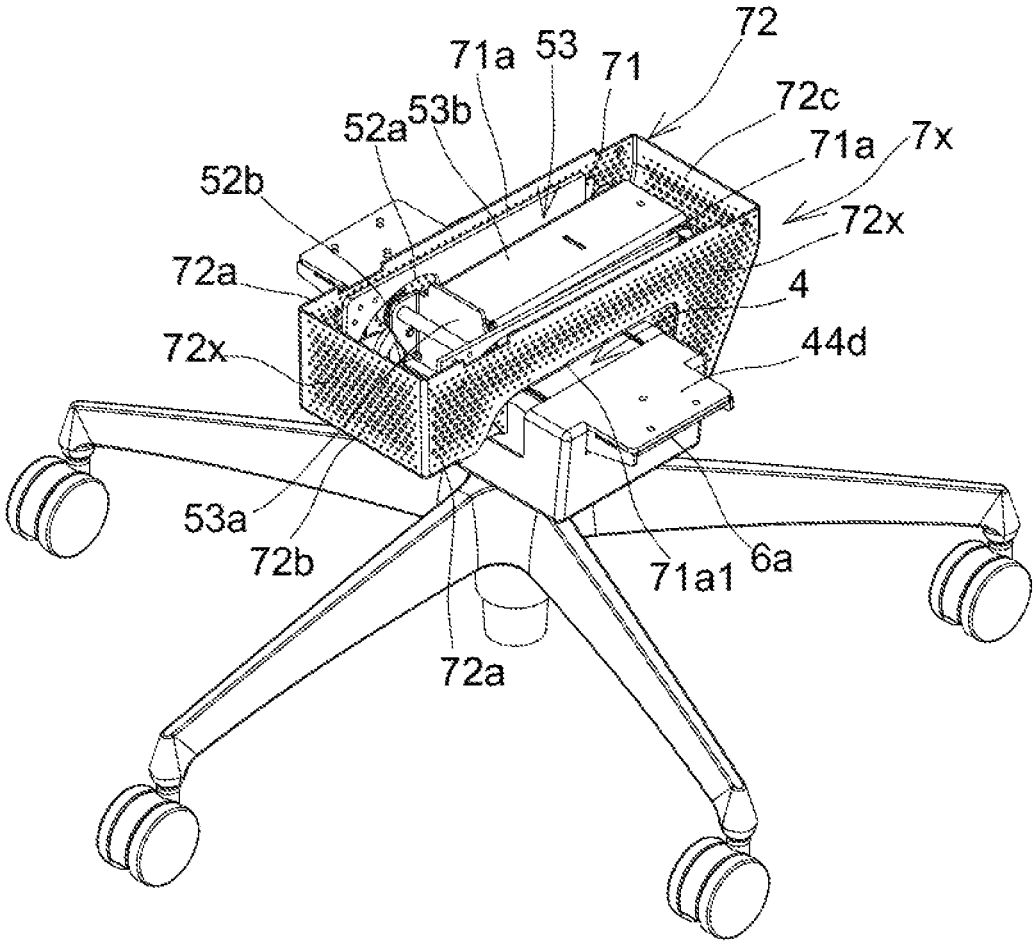
FIG. 5 is a perspective view illustrating a state of the chair according to the first embodiment of the present invention from which components located above a seat are removed.
Figure 6:
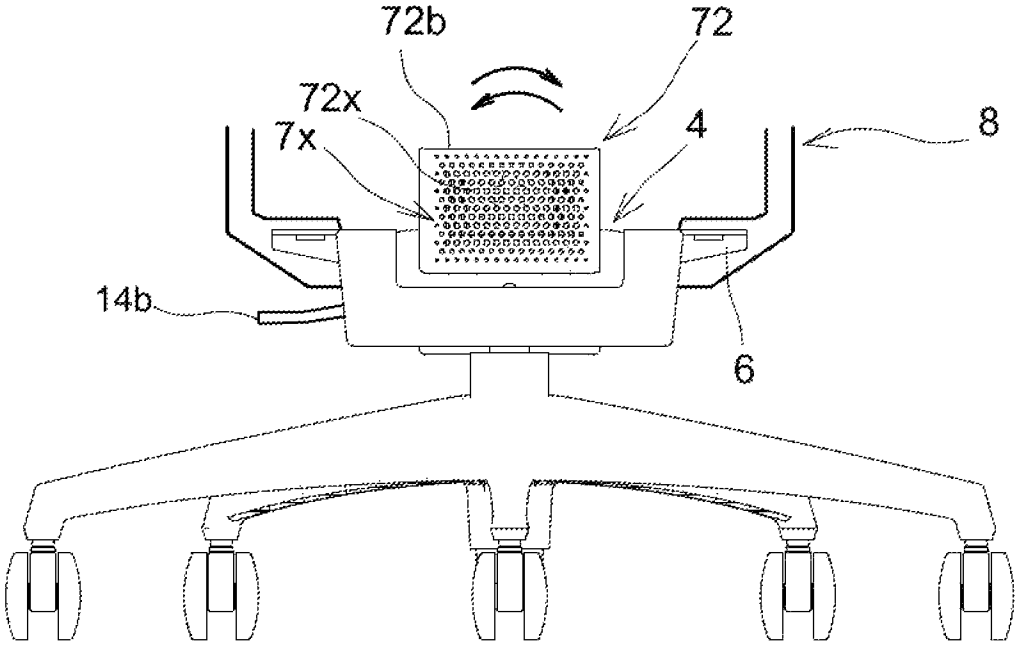
FIG. 6 is a front view illustrating a state of the chair according to the first embodiment of the present invention from which components located above a seat are removed.
Figure 7:
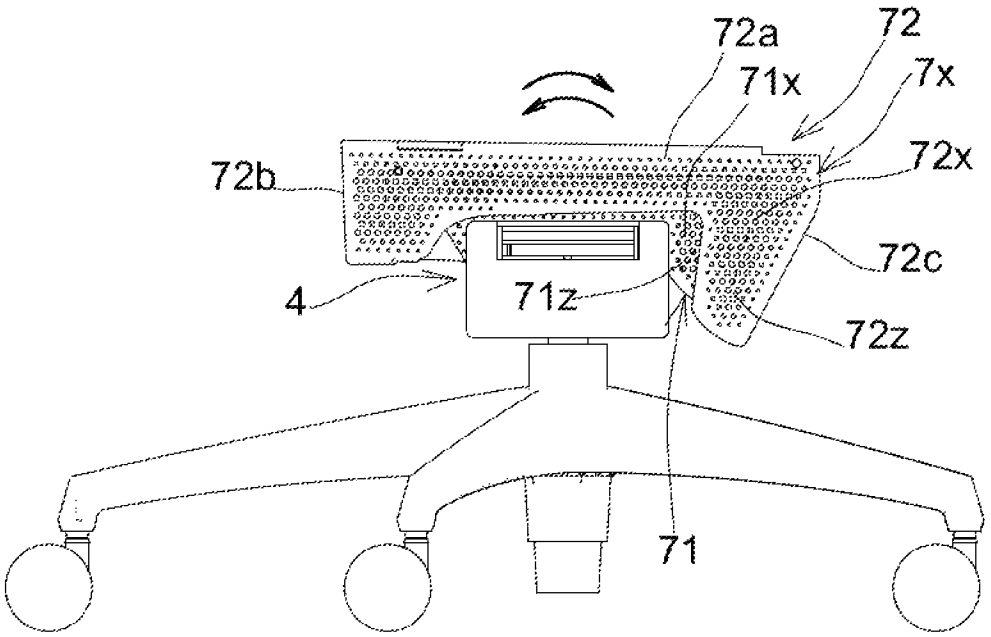
FIG. 7 is a right-side view illustrating a state of the chair according to the first embodiment of the present invention from which components located above a seat are removed.
Figure 8:
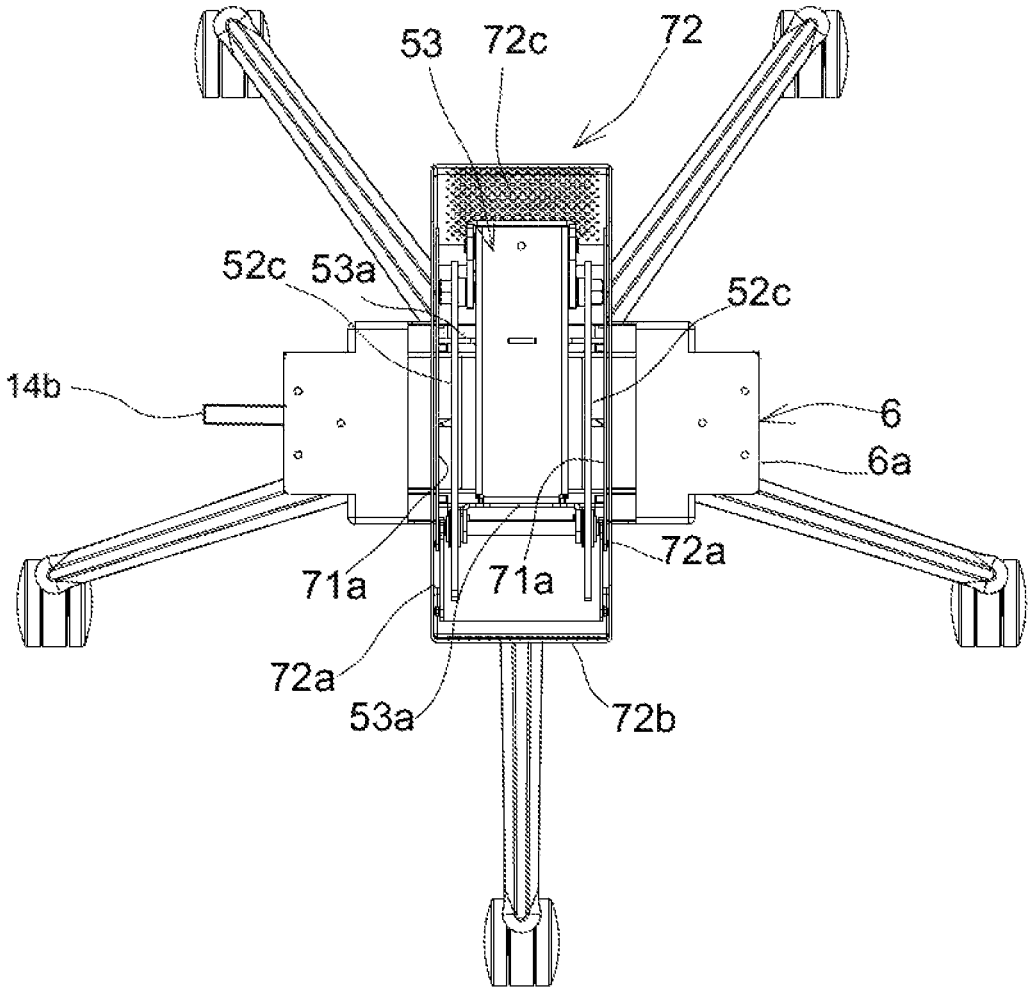
FIG. 8 is a plan view illustrating a state of the chair according to the first embodiment of the present invention from which components located above a seat are removed.
Figure 9:
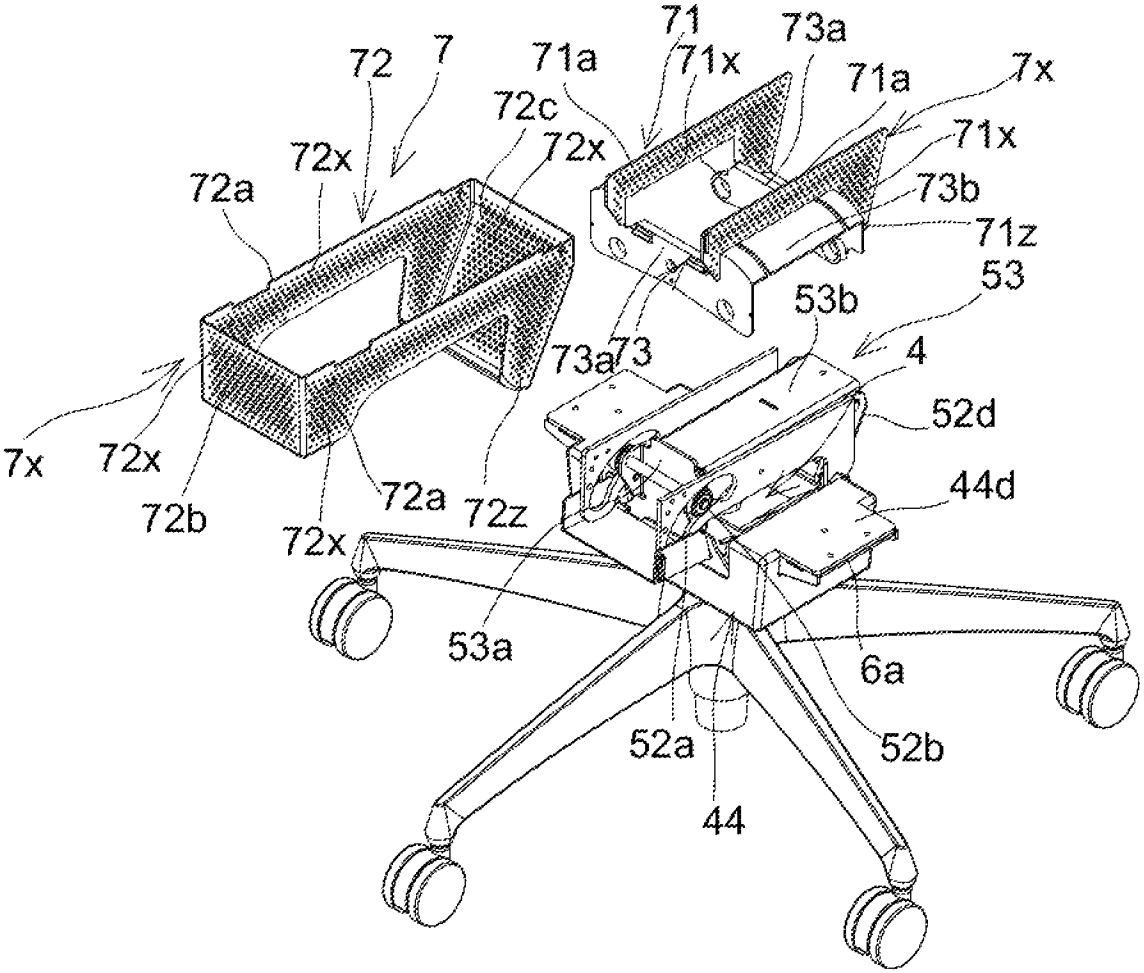
FIG. 9 is a partially exploded perspective view of FIG. 5.
Figure 10:
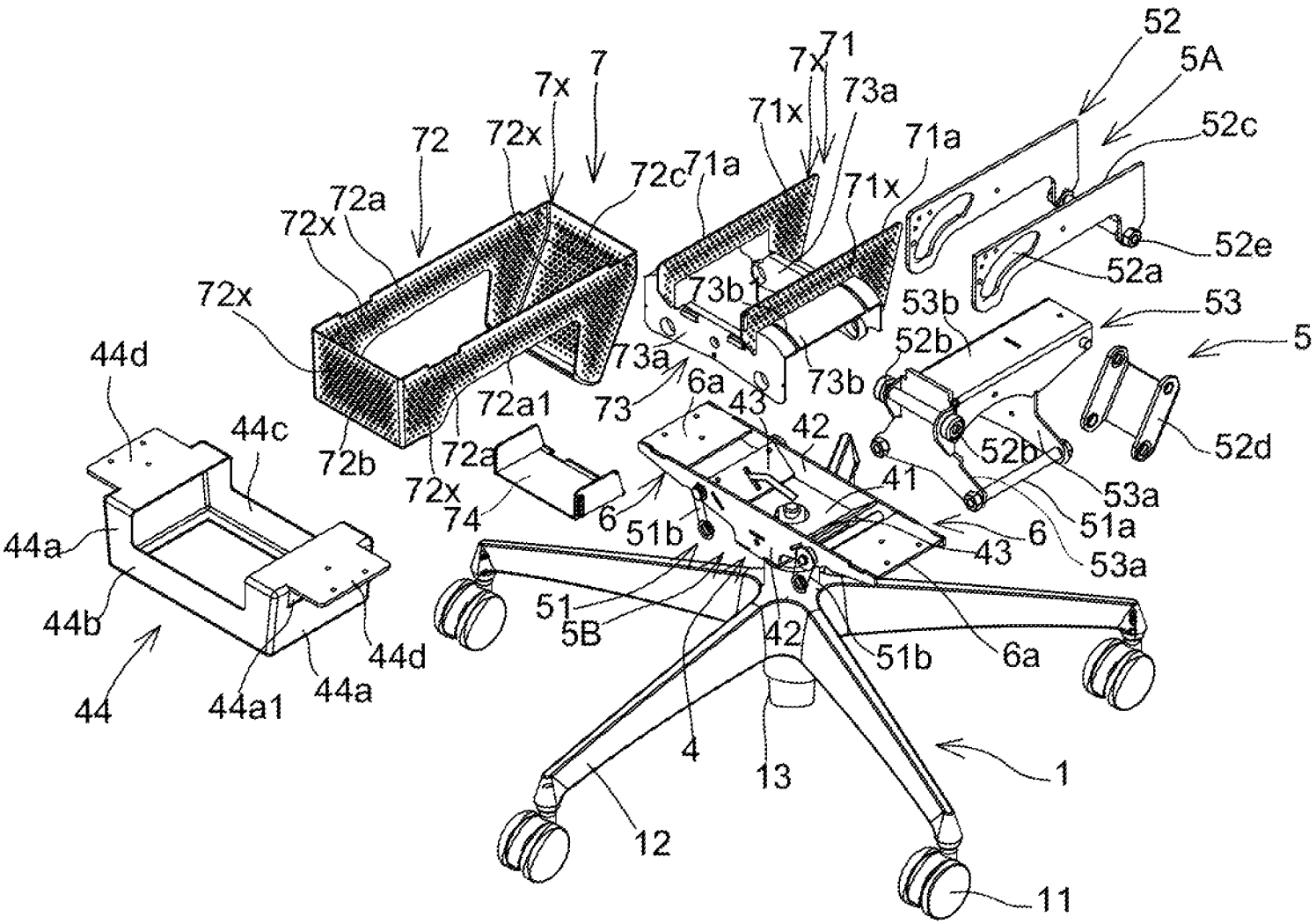
FIG. 10 is a further exploded perspective view of FIG. 9.
Figure 11:
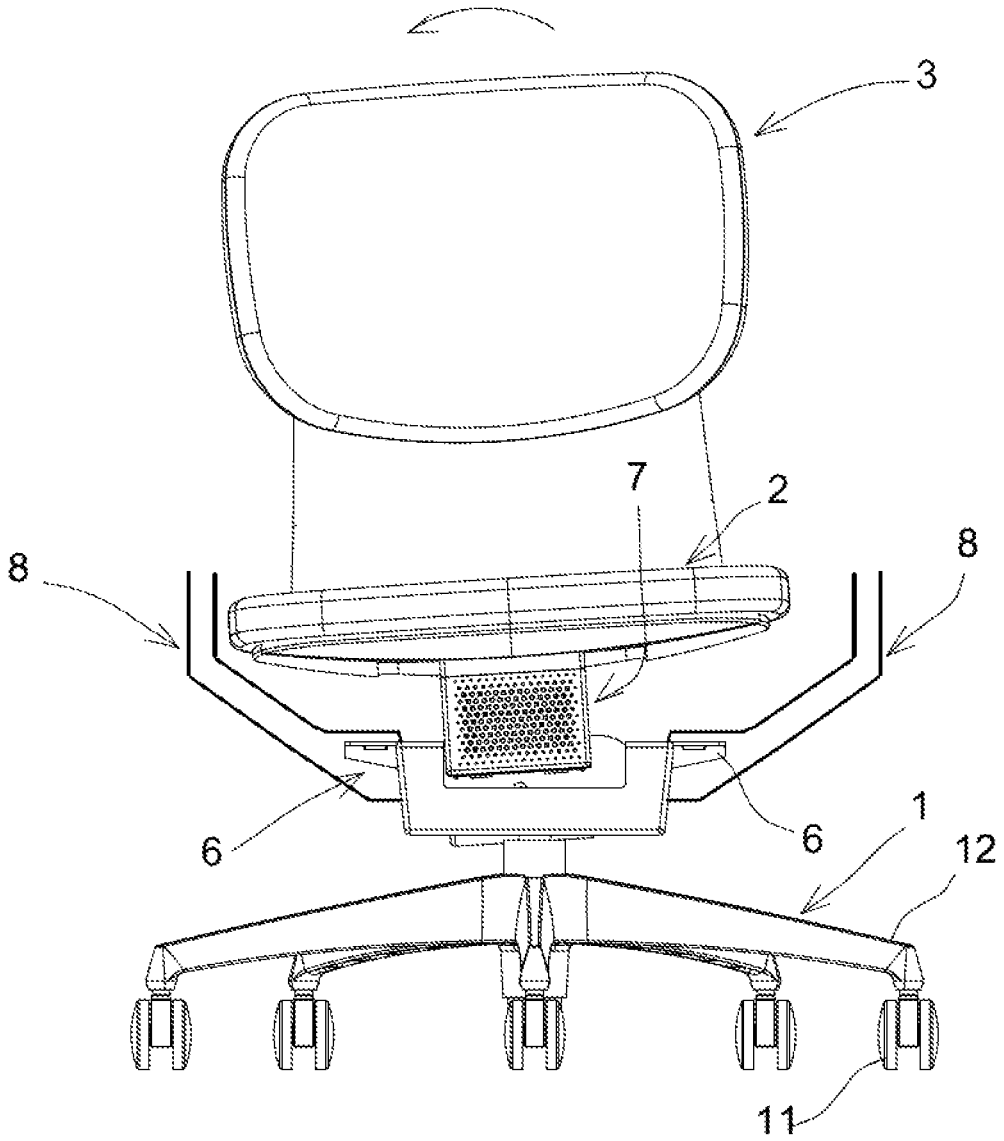
FIG. 11 is an explanatory diagram of movement according to the first embodiment of the present invention.
Figure 12:
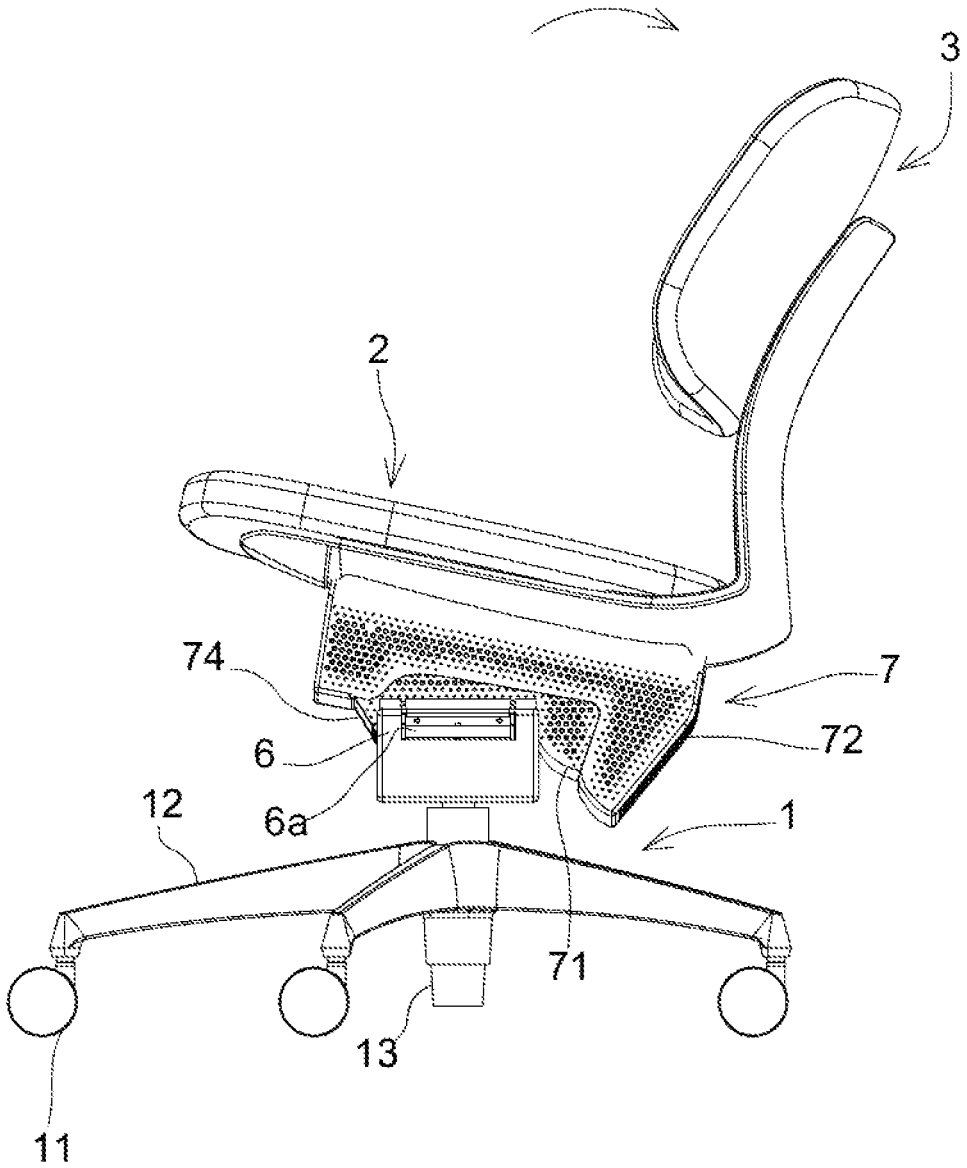
FIG. 12 is an explanatory diagram of movement according to the first embodiment of the present invention.

FIG. 1 is a perspective view of a chair according to the first embodiment. FIG. 2 is a front view of the chair according to the first embodiment. FIG. 3 is a right-side view of the chair according to the first embodiment. FIG. 4 is a lower perspective view of the chair according to the first embodiment. In addition, FIG. 5 is a perspective view illustrating a state of the chair according to the first embodiment from which components located above a seat are removed. FIG. 6 is a front view illustrating a state of the chair according to the first embodiment from which the components located above the seat are removed. FIG. 7 is a right-side view illustrating a state of the chair according to the first embodiment from which the components located above the seat are removed. FIG. 8 is a plan view illustrating a state of the chair according to the first embodiment from which the components located above the seat are removed. FIG. 9 is a partially exploded perspective view of FIG. 5. FIG. 10 is a further exploded perspective view of FIG. 9. FIGS. 11 and 12 are explanatory drawings each illustrating movement of the whole chair.

As illustrated in these drawings, the chair includes a leg 1 provided to stand from a floor surface, a seat 2 and a backrest 3 that are disposed above the leg 1, a leg support pole 13 attached to the leg 1 to support the seat 2 so that the seat 2 moves up or down and can rotate, a support base 4 fixed to an upper end of the leg support pole 13 and configured to horizontally rotate integrally with the leg support pole 13 and so as not to move in a front-rear and left-right directions in accordance with movement of the seat 2, a movement mechanism 5 interposed between the support base 4 and the seat 2 to support the seat 2 so that the seat 2 can move in the front-rear and left-right directions, an arm attachment part 6 supported by the support base 4, and a movable cover member 7 to cover the movement mechanism 5.

The seat 2 and the backrest 3 are integrally formed in the first embodiment. As illustrated in FIG. 4, a seat component 2*a* is attached to a seat corresponding portion 22 of an integral seat backrest outer shell 20, and a backrest component 3*a* is attached to a backrest corresponding portion 23 of the integral seat backrest outer shell 20. Even if the chair has a synchronized seat and backrest locking structure such that the seat 2 moves in the same direction in conjunction with the backrest 3 at a constant rate in accordance with the forward or backward tilting movement of the backrest 3, a support mechanism 5 of the first embodiment is obviously applicable to support the seat 2.

The leg 1 includes a leg blade 12 supported by casters 11, and the leg support pole 13 is fitted into a center hole of the leg blade 12. The leg support pole 13 is configured such that an upper support pole is rotatable relative to a lower outer cylinder. The support base 4 is attached to the rotatable upper support pole as illustrated in FIG. 10 or other drawings. The leg support pole 13 is a gas spring 14 that is a lifting mechanism body configuring a lifting mechanism. An operation end 14*a* of the gas spring 14 is arranged at an end position of the gas spring 14 penetrating through the support base 4.

The support base 4 is formed of a strengthening member integrally provided with a bottom wall 41, a pair of front-rear walls 42, and a pair of side walls 43 to form a ship shape. The bottom wall 41 is attached to the leg support pole 13.

The movement mechanism 5 supports the seat 2 and the backrest 3 so that each of the seat 2 and the backrest 3 moves in a certain area along a predetermined trajectory in plural directions. Specifically, the movement mechanism 5 includes a front-rear movement part 5A allowing a front-rear movement of the seat and the backrest and a left-right movement part 5B allowing a left-right movement of the seat and the backrest. The movement mechanism 5 not only moves the seat 2 and the backrest 3, but also functions as the support mechanism to support a load while moving the seat 2 in the front-rear and left-right directions. Herein, the movement mechanism 5 will be also referred to as the support mechanism 5 as required.

The support mechanism 5 includes a left-right support part 51 supporting the seat 2 movably in the left-right direction, and a front-rear support part 52 supporting the seat 2 movably in the front-rear direction.

The left-right support part 51 is configured such that left-right support portions as supported members, i.e., a pair of shafts 51*a*, are supported thought a link members 51*b* as left-right support members to suspend and support downward from the support base 4 as a support member. The pair of shafts 51*a* is supported to be swingable in the left-right direction. The shafts 51*a* are arranged below the support base 4. That is, the pair of shafts 51*a* as the left-right support portions is connected to the link members 51*b* to move in conjunction with the link members 51*b* as the left-right support members.

The front-rear support part 52 is attached though a connection member 53 to the pair of shafts 51*a* as the left-right support portions. The connection member 53 includes a pair of front and back brackets 53*a* to which the pair of shafts 51*a* is attached, and a swingable body 53*b* attached above the brackets 53*a* to hang over the support base 4 and formed in a box shape opening downward. In addition, front end portions of seat support walls 52*c* as front-rear support portions are supported on a front end portion of the swingable body 53*b* though cam surfaces 52*a* and cam followers 52*b*, both of which are front-rear support members. Rear end portions of the seat support walls 52*c* as the front-rear support portions are supported on a rear end portion of the swingable body 53*b* though a link member 52*d* as a front-rear support member. That is, the seat support walls 52*c* as the front-rear support portions are arranged above the support base 4. Further, in the first embodiment, as an example that the cam followers 52*b* are indirectly provided on the swingable body 53*b*, a mode that upper ends of the front bracket 53*a* of a sheet metal material fixed to the front end portion of the swingable body 53*b* are bent forward and the cam followers 52*b* are pivotally attached to the bent portions, is applied. That is, the seat support walls 52*c* as the front-rear support portions are connected to move in conjunction with the cam surfaces 52*a*, the cam followers 52*b*, and the link member 52*d*, all of which are the front-rear support members.

In addition, the seat 2 is attached to upper ends of the seat support walls 52*c*.

Each of the link members 51*b* of the left-right support part 51 is formed in a shape expanding from a reference position toward the upper side. Therefore, inside a cover member 72 described below based on FIG. 6, is configured to downwardly incline a tip side in a movement direction of the link member 51*b* as indicated by arrows in FIG. 6 in accordance with swinging of the shafts 51*a* as the left-right support portions from the reference position. In addition, as being dislocated from the reference position, the link members 51*b* move such that a center position between the shafts 51*a*, 51*a* is elevated.

Furthermore, the seat support walls 52*c* being the front-rear support portions is set so that the front end portion is supported at an intermediate position of the cam surface 52*a* inclining forward and downward from a reference position, by the cam follower 52*b* and the rear end portion is supported by the link member 52*d* hanging forward and downward from a reference position. Accordingly, inside the front-rear cover member 72 described below based on FIG. 7, when the seat support wall 52*c* as the front-rear support portion moves forward from the reference position, the front end thereof is moved downward, and the rear end thereof is moved upward. Meanwhile, when the seat support wall 52*c* moves rearward, the front end thereof is moved upward and the rear end thereof is moved downward, and in addition, as being dislocated from the reference position, the seat support wall 52*c* moves such that a center position of the seat support wall 52*c* is elevated.

As a result, the seat 2 can move in the left-right direction while moving in the front-rear direction, and a moving tip side of the seat 2 inclines downward, as being dislocated from a reference position, the seat 2 is supported such that a center position of the seat 2 is elevated.

The arm attachment parts 6 are integrally provided on the support base 4 and ends 6*a* of the respective arm attachment parts 6 are located at positions laterally extended from the support base 4 to the right side and the left side.

Specifically, the front-rear support part 52 is located above an upper portion of the support base 4 attached to an upper portion of the leg support pole 13, and the left-right support part 51 is disposed below the upper portion of the support base 4. Therefore, a space for extending the arm attachment parts 6 exists between the front-rear support part 52 and the left-right support part 51. Consequently, the arm attachment parts 6 can be formed in a manner to be laterally extended without interfering with the front-rear support part 52 and the left-right support part 51.

More specifically, the link members 51*b* as a pair of right and left support members are pivotally attached to the support base 4 to suspend therefrom. The cam surfaces 52*a* and the cam followers 52*b*, which are a pair of front and back support members, are arranged though the bracket 53*a* from the shafts 51*a* as the left-right support portions supported by the link members 51*b*, and a link shaft 52*e* is arranged though the bracket 53*a* from the shafts 51*a*. Further, the seat support walls 52*c* as the front-rear support portions are attached to the cam surfaces 52*a*, the cam followers 52*b* and the link member 52*d*. Furthermore, the seat 2 is attached to the seat support walls 52*c*. That is, the link members 51*b* are provided to suspend from the support base 4 and thereby the shafts 51*a* as the left-right support portions located at lower ends of the link members 51*b* are arranged below the support base 4 and located separately from each other. In addition, the seat support walls 52*c* substantially horizontally shift while swinging when being moved in the front-rear direction by the cam surfaces 52*a*, the cam followers 52*b* and the link member 52*d*, and thus do not largely move up and down. Therefore, a space for extending the arm attachment parts 6 and an attachment place for attaching the seat 2 are appropriately secured.

A fixation cover 44 is attached to the support base 4. The fixation cover 44 is integrally provided in a frame shape in planar view with right and left side fixation walls 44*a*, a front fixation wall 44*b*, and a back fixation wall 44*c*, and arm fixation portions 44*d* are integrally provided to laterally extend between an intersection between each of the side fixation walls 44*a* and the front fixation wall 44*b* and an intersection between each of the side fixation walls 44*a* and the back fixation wall 44*c*. Various specific attachment procedures may be taken. The support base 4 is arranged in the frame-shaped space of the fixation cover 44, and the arm attachment parts 6 are arranged to be laterally extend through openings 44*a*1 formed in the respective side walls 44*a* of the fixation cover 44 in with lower portions of the respective arm fixation portions 44*d*.

Further, an operation lever 14*b* illustrated in FIG. 2 and configured to operate the operation end 14*a* of the gas spring 14 is disposed on a lower surface of one of the arm fixation portions 44*d*.

Furthermore, as illustrated in FIG. 6 and FIG. 11, arms 8 are detachably attached to the arm attachment parts 6. In addition, each of the arms 8 is fixed to the arm attachment part 6 from the lower or lateral side of the arm attachment part 6 by a fastening member such as a bolt.

On the other hand, as illustrated in FIG. 10, the movable cover member 7 includes a left-right cover member 71 attached to the left-right support part 51, a front-rear cover member 72 attached to the front-rear support part 52, and an interpolation cover member 74 interposed between the left-right cover member 71 and the front-rear cover member 72. The front-rear cover member 72, the left-right cover member 71, and the interpolation cover member 74 are configured in combination, therefore configuring the cover member 7. In addition, in accordance with movements of the plural movement parts 5A, 5B, the cover members 72, 71 move relatively in different directions in a certain area along a predetermined trajectory.

Specifically, the left-right cover member 71 includes a pair of right and left standing walls 71*a* each formed in a substantially L-shape. The left-right cover member 71 is attached to a cover attachment member 73. The cover attachment member 73 includes a pair of front and back support plates 73*a* and a cover plate 73*b* connecting between the support plates 73*a*, 73*a*. The support plate 73*a* is swingable attached to swing ends of the respective link members 51*b* together with the shafts 51*a* as the left-right support portions. In such an attaching state, the seat support walls 52*c* as the front-rear support portions are arranged inside the front-rear cover member 72, and the seat support walls 52*c* swing in the left-right direction together with the front-rear cover member 72.

In addition, as illustrated in FIG. 11, in accordance with the left-right swinging of the seat support walls 52*c*, the seat 2 fixed to the seat support walls 52*c* swings in the left-right direction together with the backrest 3. FIG. 11 illustrates an operation in which the seat 2 swings to the left side of FIG. 11. Likewise, obviously, the seat 2 may swing to the right of FIG. 11.

Here, the arms 8 detachably attached to the arm attachment parts 6 provided on the support base 4 do not move in accordance with the swinging of the seat 2. In addition, each of the arms 8 is shaped not to make contact with the seat 2 even at a swing end of the seat 2 in the left-right direction.

Meanwhile, the front-rear cover member 72 is configured such that right and left standing side walls 72*a*, a front wall 72*b*, and a back wall 72*c* tilted rearward are connected in a frame shape in planar view. The front-rear cover member 72 includes a space inside thereof in which the left-right cover member 71 can be housed. The front-rear cover member 72 is attached to the seat support walls 52*c* as the front-rear support portions, and configure so that while the front-rear cover member 72 swings together with the seat support walls 52*c* in the left-right direction and the front-rear direction, the cam surfaces 52*a* and the cam followers 52*b*, both of which are the front-rear support members, are covered and hidden by the side walls 72*a* and the front wall 72*b*, and the link member 52*d* as the front-rear support member is covered and hidden by the side walls 72*a* and the back wall 72*c*. Therefore, each of the side walls 72*a* is formed in a reversed L-shape. In addition, as illustrated in FIG. 4, a front bottom wall 72*b*1 substantially horizontally disposed is provided at a lower end portion of the front wall 72*b*. The front bottom wall 72*b*1 is consistently contactable with a portion of the interpolation cover member 74.

Meanwhile, the interpolation cover member 74 is interposed between the left-right cover member 71 and the front-rear cover member 72. Specifically, the interpolation cover member 74 is rotatably engaged though a shaft 74*a* with an upper end on the front side of the cover attachment member 73, therefore being rotatably attached in the front-rear direction.

A space in which an opening between the facing side walls 71*a*, 71*a* of the left-right cover member 71 is communicated with an opening between the facing side walls 72*a*, 72*a* of the front-rear cover member 72 corresponds to a space in which the foregoing connection member 53 to connect the left-right support part 51 to the front-rear support part 52 is arranged.

As illustrated in FIGS. 5 and 8, each of the side walls 72*a* of the front-rear cover member 72 is located adjacent to each of the side walls 71*a* of the left-right cover member 71; however, the front-rear cover member 72 swings together with the left-right cover member 71 in the left-right direction and therefore a gap between the side wall 72*a* and the side wall 71*a* is maintained. Meanwhile, the left-right cover member 71 does not swing in the front-rear direction, and the front-rear cover member 72 swings in the front-rear direction. Therefore, gaps are provided between the front wall 72*b* of the front-rear cover member 72 and front ends of the respective side walls 71*a* of the left-right cover member 71 and between the back wall 72*c* of the front-rear cover member 72 and rear ends of the respective side walls 71*a* of the left-right cover member 71 such that the relative movement does not cause interference therebetween.

Thus, the cover member 7 is configured such that the left-right cover member 71 and the front-rear cover member 72 move relatively while coming close to each other with the gaps between the cover members 71, 72.

As just described, the cover members 71, 72 moves following in accordance with the movement of the seat 2, and in addition, can cover the support mechanism 5. That is, for the left-right movement of the seat 2, the cover members 71, 72 cover the support mechanism 5 while swinging in the left-right direction, as indicated by arrows in FIG. 6, in accordance with the left-right swinging of the left-right support part 51 configuring the support mechanism 5. In this case, recessed portions 72*a*1 are formed at lower portions of the respective side walls 72*a* of the front-rear cover member 72; therefore, even when swinging in the left-right direction, the front-rear cover member 72 is prevented from interfering with components of the support base 4. Also, as illustrated in FIG. 10, slits 73*b*1 are provided in the cover plate 73*b* of the cover attachment member 73 to which the left-right cover member 71 is attached. At the time of swinging, the front and back walls 42 of the support base 4 are received in the slits 73*b*1. Therefore, even when the cover attachment member 73 is arranged closely to the support base 4, an interference between the cover attachment member 73 and the support base 4 is avoided, and in addition, the role of a gap insertion plate to close a gap consistently inserted in the gap between the support base 4 and the left-right support part 51 is played.

Here, as illustrated in FIG. 12, the seat support walls 52*c* as the front-rear support portions are connected to move in conjunction with the cam surfaces 52*a*, the cam followers 52*b*, and the link member 52*d*, all of which are the front-rear support members. Therefore, the seat 2 fixed to the seat support walls 52*c* swings in the front-rear direction. FIG. 12 illustrates the swinging of the seat 2 to the back side, i.e., the swinging of the seat 2 to the right side of FIG. 12. Obviously, the seat 2 is swingable further forward than a state illustrated in FIG. 3.

For the front-rear movement of the seat 2 as above, in the same way as illustrated in FIG. 7, the front-rear cover member 72 swings in the front-rear direction in accordance with the front-rear swinging of the front-rear support part 52 configuring the support mechanism 5, but the left-right support part 51 does not swing in the front-rear direction. Therefore, a downward protrusion portion 71*z* forming the reversed L-shape of each of the side walls 71*a* of the left-right cover member 71 and a downward protrusion portion 72*z* forming the reversed L-shape of each of the side walls 72*a* of the front-rear cover member 72 cover together a movement range of the link member 52*d* to hide the movement range. In addition, the left-right cover member 71 closes a gap between each of the recessed portions 72*a*1 of the front-rear cover member 72 and the support base 4.

Consequently, even when the cover members 71, 72 execute a complex movement to each other, foreign objects are prevented from being trapped between the cover members 71, 72 or between the support base 4 and the cover members 71, 72.

On the other hand, at the time of the front-rear swinging of the seat 2 as illustrated in FIG. 12, the alms 8 detachably attached to the respective arm attachment parts 6 provided on the support base 4 do not move in accordance with the swinging of the seat 2. Further, as illustrated in FIG. 11, even at a swing movement end of the seat 2 in the left-right direction, each of the arms 8 does not make contact with, the seat 2.

Furthermore, at the time of the front-rear movement of the seat 2, inside the front-rear cover member 72, the interpolation cover member 74 rotatably attached to a front end of the cover attachment member 73 rotates around the shaft 74*a* with respect to the left-right Cover member 71. In other words, the interpolation cover member 74 rotates around the shaft 74*a* at a base end side with contacting to the front bottom wall 72*b*1 of the front-rear cover member 72 with leaning on the front bottom wall 72*b*1 at a tip end. Thus, generation of a gap between a front end portion of the left-right cover member 71 and the front-rear cover member 72 is effectively avoided.

Also, in the first embodiment, through-holes 7*x* each including a round hole are formed in any of the cover members 71, 72. The through-hole 7*x* includes through-holes 71*x*, 72*x* formed in the both cover members 71, 72 respectively in the first embodiment. The plural through-holes 71*x*, 72*x* are arranged lengthwise and breadthwise at equal intervals, moreover, at substantially equal pitches in the front-rear direction and the left-right direction entirely in respective surfaces. The hole diameter is designed to be small at a location adjacent to a rim of the cover member. Further, the through-holes 71*x*, 72*x* are arranged on the surfaces surrounding the movement mechanism 5 such that when one of the through-holes 71*x*, 72*x* is viewed from the outer surface side, the other of the through-holes can be visually recognized from the inner surface side. In a location where the through-holes 71$x$, 72$x$ are arranged on the two facing surfaces or the two adjoining surfaces of each of the cover members 71, 72, in particular, when one of the through-holes 71$x$, 72$x$ is viewed from the outer surface side, the other of the through-holes 71$x$, 72$x$ is easily visually recognized from the inner surface side and thus light transmission properties are easily secured. Furthermore, since the through-holes 71$x$, 72$x$ are arranged entirely in the standing surfaces, the light transmission properties are secured in any directions. The size and shape of the through-hole of the first embodiment is designed such that a cylinder with a diameter of 8 mm is not allowed to insert into the through-hole. The aperture ratio of such through-holes 71$x$, 72$x$ is preferably 10% or higher in each of the surfaces including the through-holes 71$x$, 72$x$, and is further preferably 15% or higher. It is to be noted that the shape of the through-hole 7$x$ is not limited to a circle. Alternatively, through-holes of various shapes such as a slit-shaped through-hole or a cross-shaped through-hole may be applied as the through-hole 7$x$. Moreover, the through-holes 7$x$ are arranged in the both cover members 71, 72, but not limited to such a configuration. Alternatively, the through-hole 7$x$ may be arranged either one of the cover members (the cover member 71 or the cover member 72).

Second Embodiment

Hereinafter, a second embodiment of the present invention will be described with reference to the drawings. In the second embodiment, the same reference numbers are assigned to components corresponding to those of the foregoing first embodiment and detailed explanations of the components will be omitted.

Figure 13:
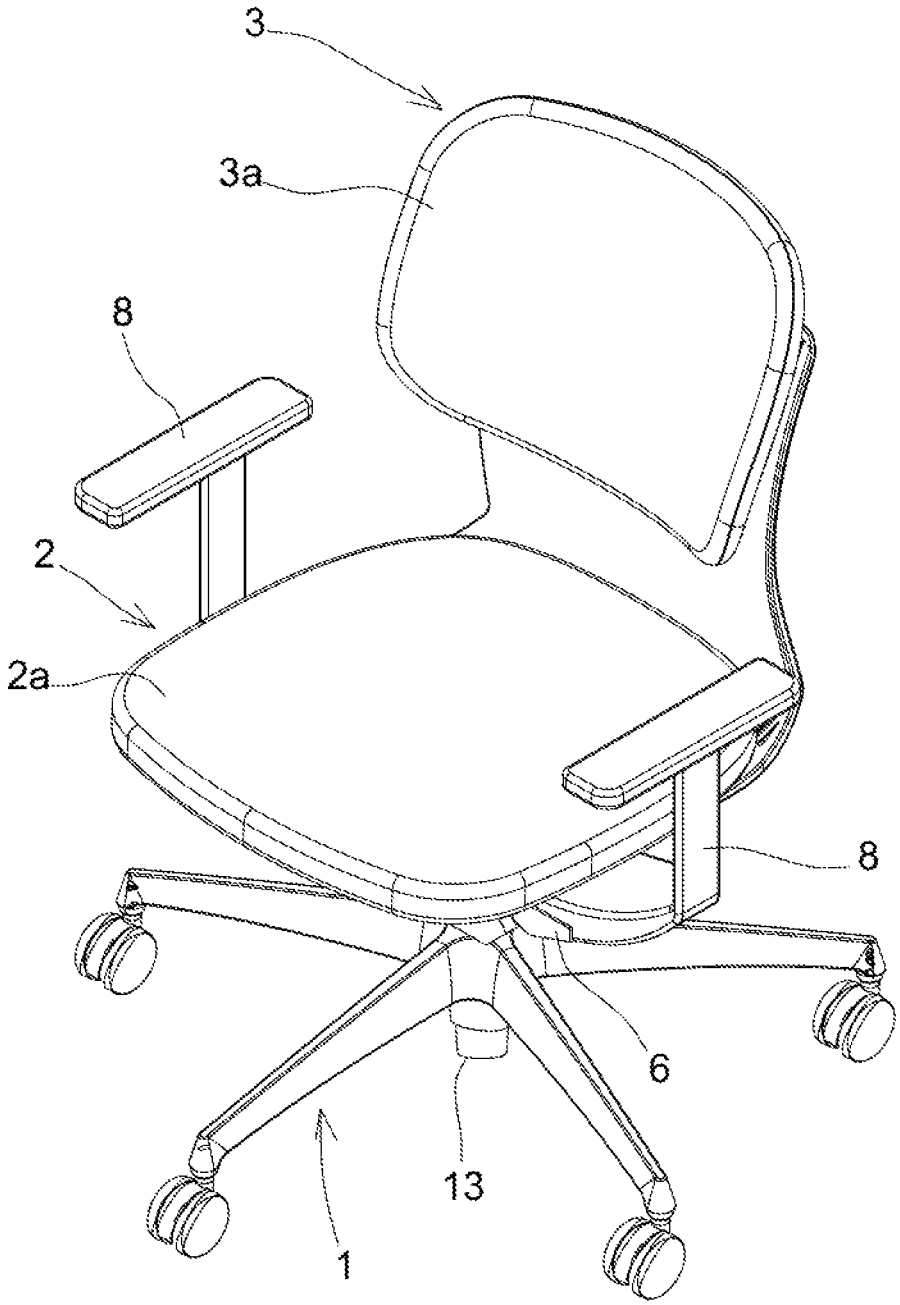
FIG. 13 is a perspective view of the chair according to a second embodiment of the present invention.
Figure 14:
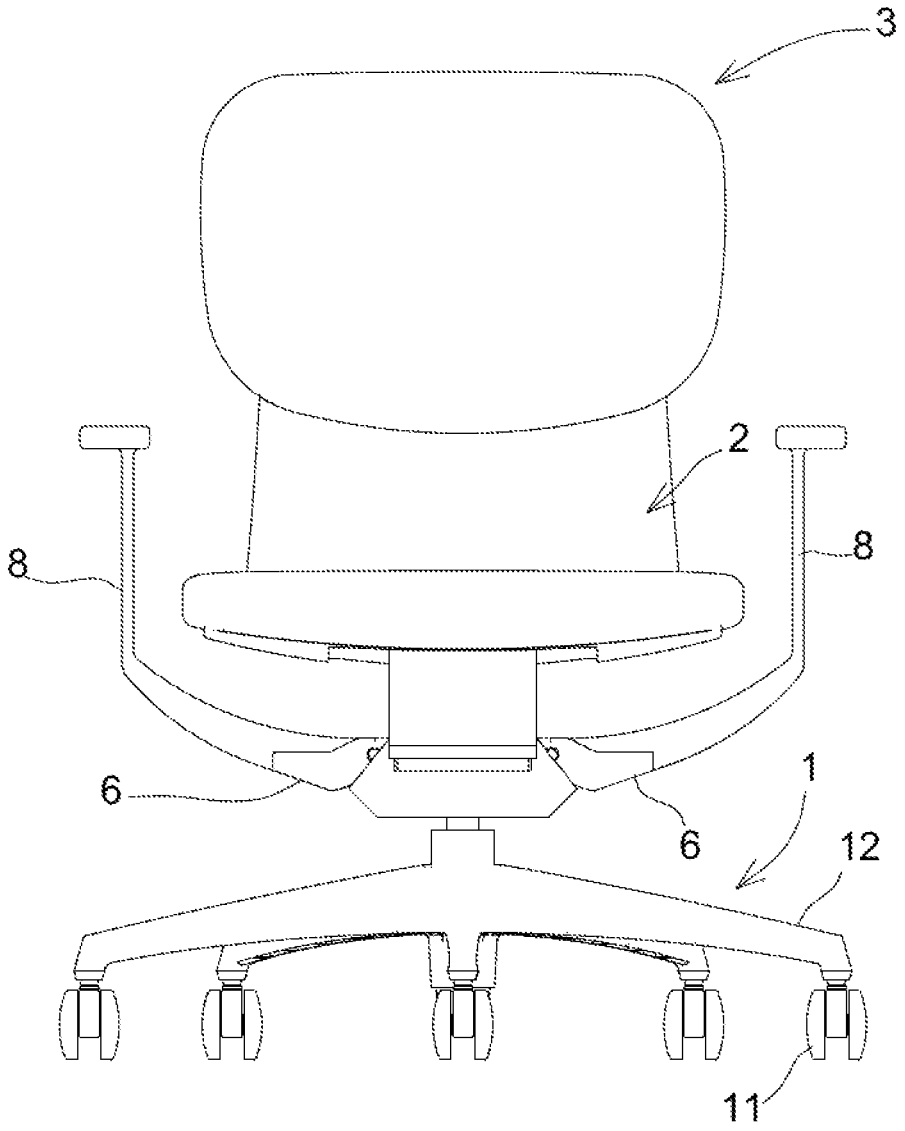
FIG. 14 is a front view of the chair according to the second embodiment of the present invention.
Figure 15:
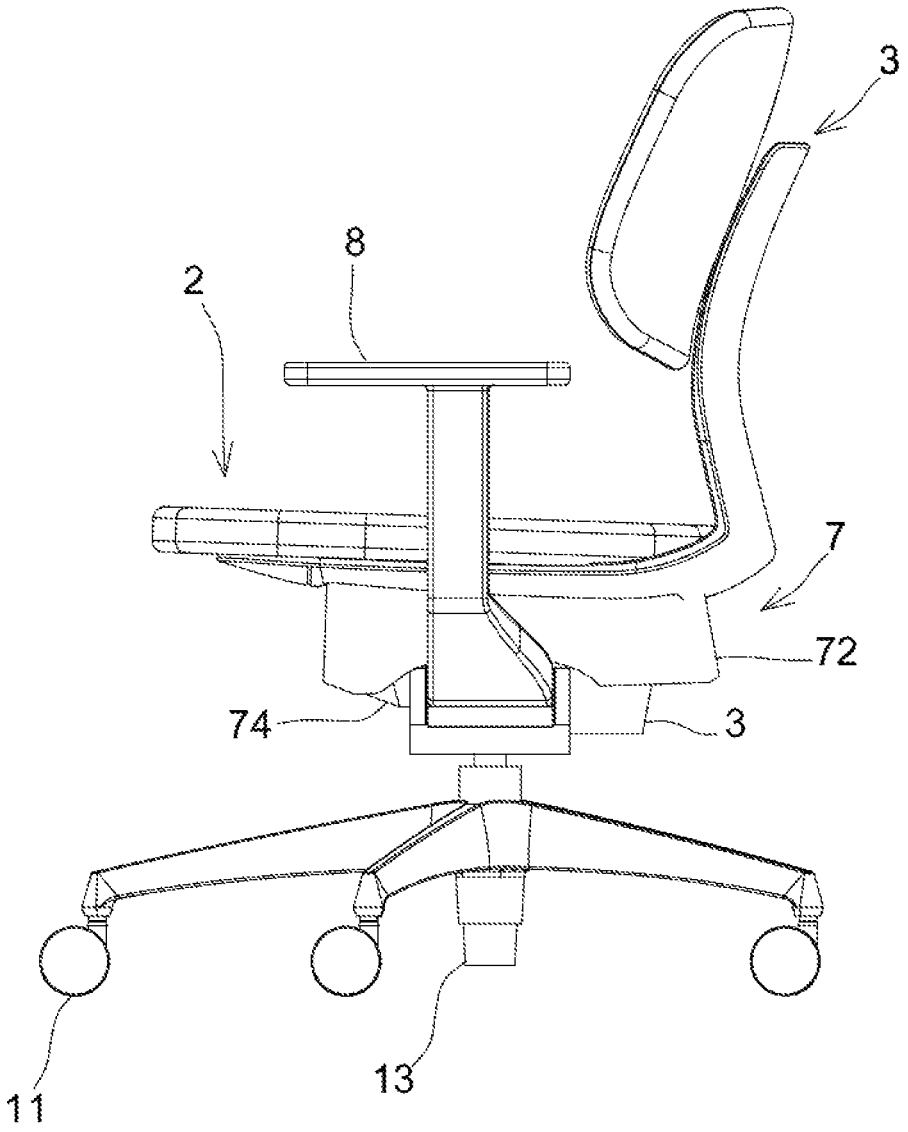
FIG. 15 is a right-side view of the chair according to the second embodiment of the present invention.
Figure 16:
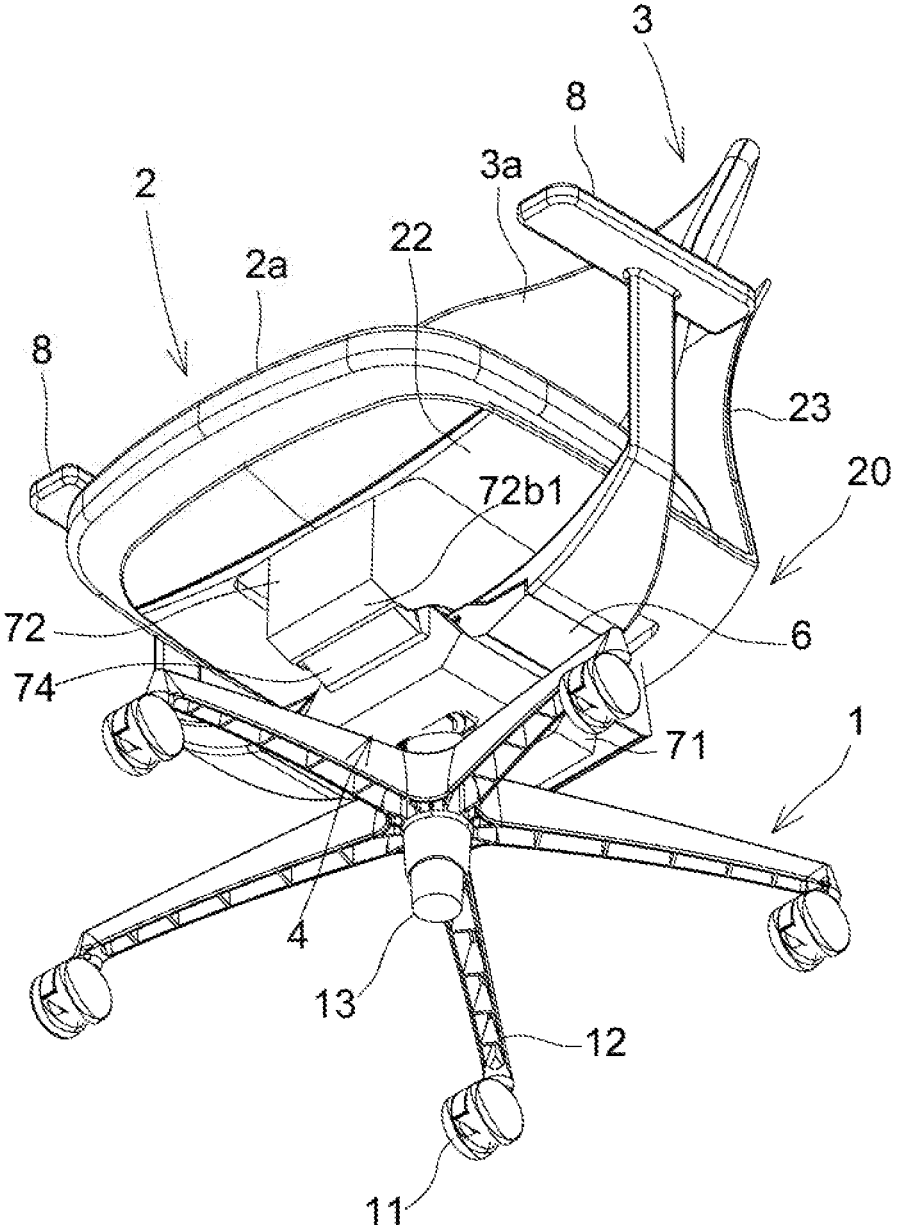
FIG. 16 is a lower perspective view of the chair according to the second embodiment of the present invention.
Figure 17:
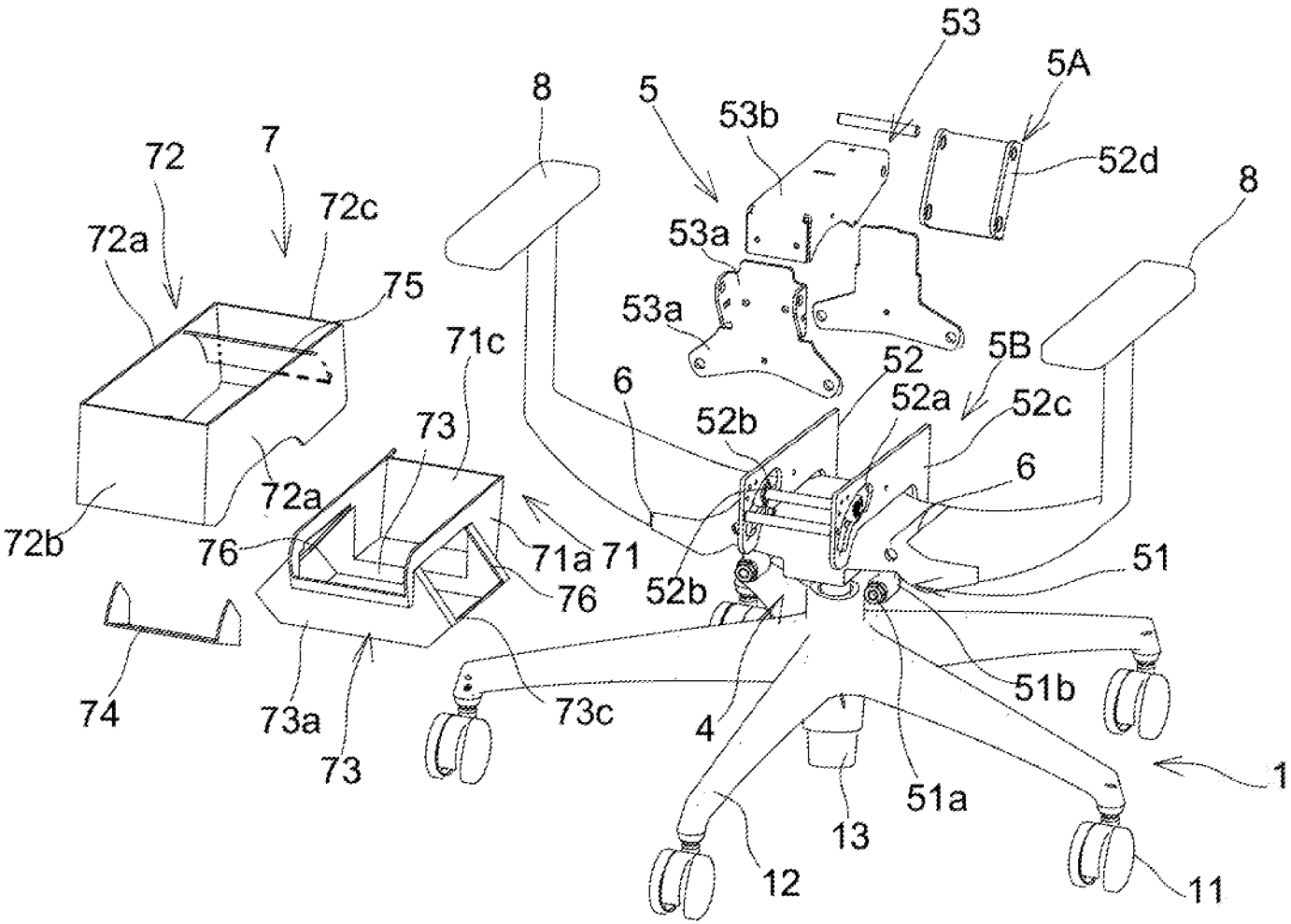
FIG. 17 is an exploded perspective view of major parts according to the second embodiment of the present invention.
Figure 18:
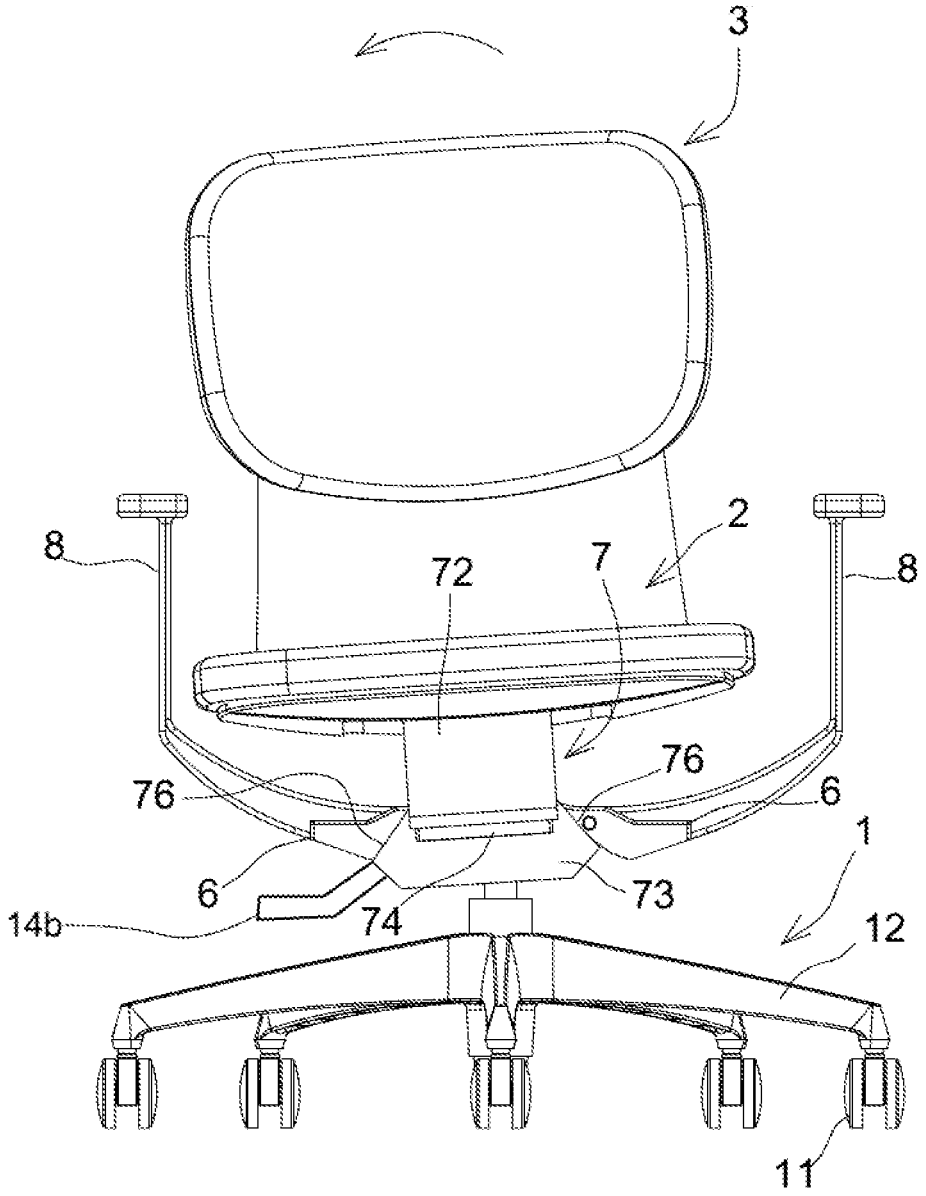
FIG. 18 is an explanatory diagram of movement according to the second embodiment of the present invention.
Figure 19:
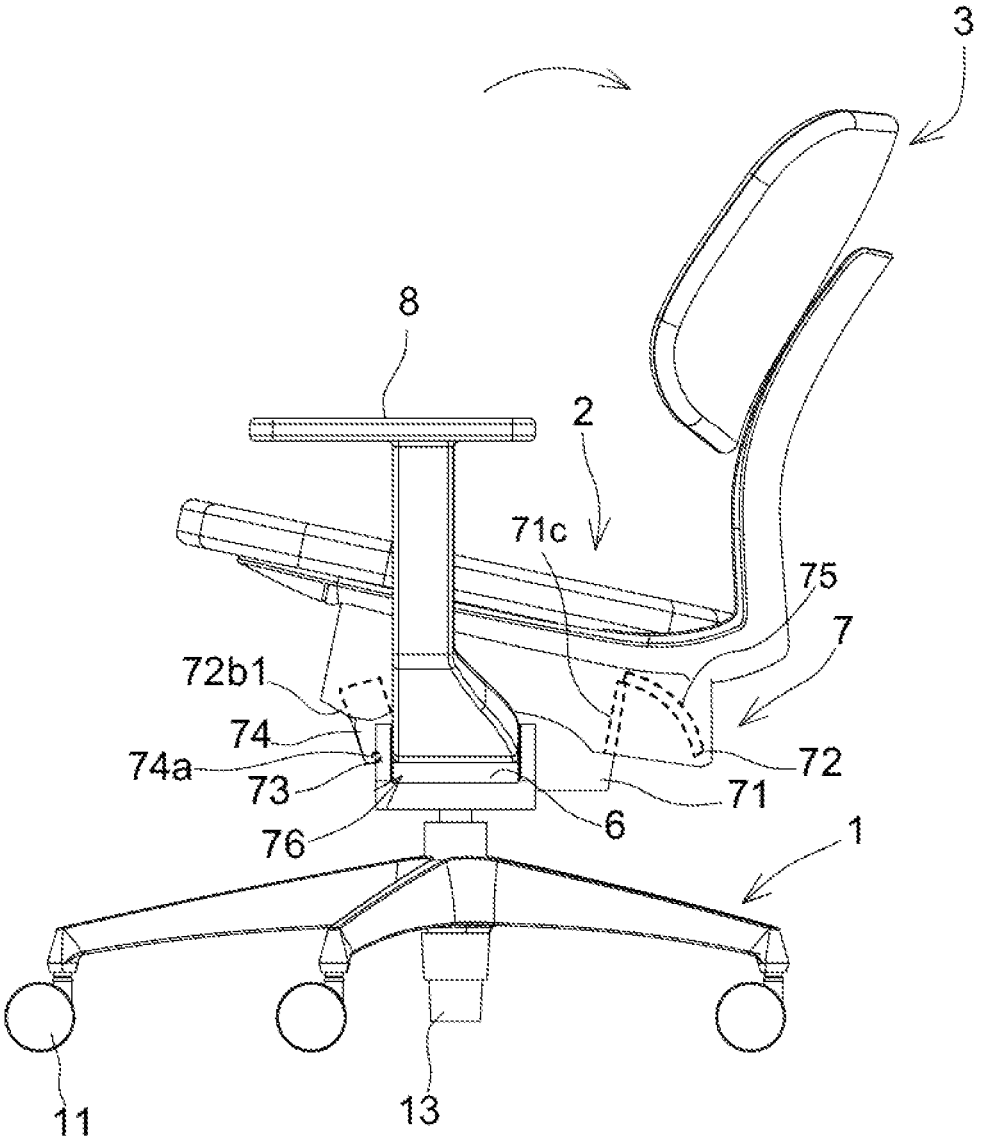
FIG. 19 is an explanatory diagram of movement according to the second embodiment of the present invention.
Figure 20:
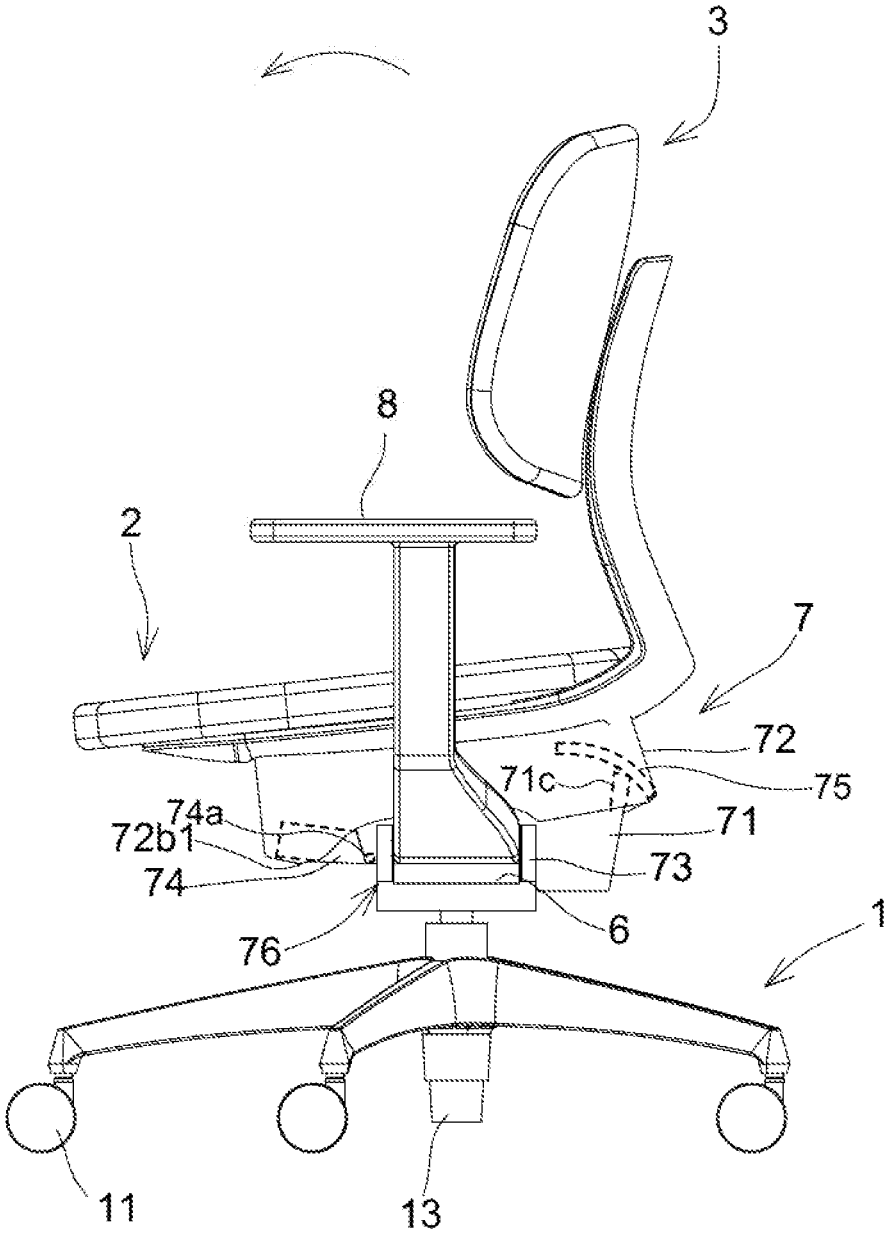
FIG. 20 is an explanatory diagram of movement according to the second embodiment of the present invention.

FIG. 13 is a perspective view of a chair according to the second embodiment. FIG. 14 is a front view of the chair according to the second embodiment. FIG. 15 is a right-side view of the chair according to the second embodiment. FIG. 16 is a lower perspective view of the chair according to the second embodiment. Also, FIG. 17 is an exploded perspective view of the chair according to the second embodiment from which the components located above the seat are removed. FIGS. 18 to 20 are explanatory diagrams of movement of the whole chair.

As illustrated in these drawings, in the same way as in the first embodiment, the chair according to the second embodiment includes the leg 1 provided to stand from a floor surface, the seat 2 and the backrest 3 that are disposed above the leg 1, the leg support pole 13 attached to the leg 1 to support the seat 2 so that the seat 2 moves up and down and can rotate, the support base 4 arranged to the upper end of the leg support pole 13 and configured to horizontally rotate integrally with the leg support pole 13 and not to move in the front-rear direction and the left-right direction in accordance with the movement following of the seat 2, the movement mechanism 5 interposed between the support base 4 and the seat 2 to support the seat 2 so that the seat 2 moves in the front-rear direction and the left-right direction, the arm attachment parts 6 supported by the support base 4, and the movable cover member 7 to cover the movement mechanism 5.

Here, in the second embodiment, a state where the arms 8 are attached to the respective arm attachment parts 6 is illustrated, and the movable cover member 7 having a different shape from that of the foregoing first embodiment is applied. The movable cover member 7 according to the second embodiment is shaped such that in particular, a rear portion is compact compared with the cover member 7 of the first embodiment.

Hereinafter, in the second embodiment, the shape of the movable cover member 7 and the behavior of the movable cover member 7 in accordance with swinging of the chair will be mainly described. It is to be noted that in the second embodiment, the through-holes 71$x$, 72$x$ being the through-hole 7$x$ formed in the same round hole as one of the fast embodiment is formed in any of the cover members 71, 72. However, in the second embodiment, the through-hole 7$x$ is not illustrated.

As illustrated in FIG. 17, the movable cover member 7 includes the left-right cover member 71 attached to the left-right support part 51, the front-rear cover member 72 attached to the front-rear support part 52, the interpolation cover member 74 interposed between a front end of the left-right cover member 71 and the front-rear cover member 72, and a back cover member 75 interposed between a rear end of the left-right cover member 71 and the front-rear cover member 72. The back cover member 75 is not provided in the first embodiment. That is, the front-rear cover member 72, the left-right cover member 71, the interpolation cover member 74, and the back cover member 75 are combined, therefore configuring the cover member 7. In addition, in accordance with movements of the plural movement parts 5A, 5B, the cover members 71, 72 move relatively in different directions in a certain area along a predetermined trajectory.

Specifically, in the second embodiment, the left-right cover member 71 includes the pair of right and left standing walls 71$a$ each formed in a substantially L-shape. The left-light cover member 71 is attached to the cover attachment member 73. The cover attachment member 73 includes the pair of front and back support plates 73$a$ and a connection plate 73$c$ connecting between the support plates 73$a$, 73$a$. The support plate 73$a$ is swingably attached to the swing ends of the respective link members 51$b$ together with the shafts 51$a$ as the left-right support portions.

Here, in the second embodiment, arm insertion holes 76$a$ allowing insertion of the arm attachment parts 6 are formed in the side of the left-right cover member 71. Specifically, each of the arm insertion holes 76 is a substantially rectangular opening provided between each of the pair of right and left standing walls 71$a$ and the connection plate 73$c$. The aim insertion hole 76 is formed to face obliquely upward.

In addition, as illustrated in FIG. 18, in accordance with the left-right swinging of the seat support walls 52$c$, the seat 2 fixed to the seat support walls 52$c$ swings in the left-right direction together with the backrest 3. FIG. 18 illustrates an operation in which the seat 2 swings to the left side of FIG. 18. Likewise, obviously, the seat 2 may swing to the right of FIG. 18.

Here, the arms 8 detachably attached to the arm attachment parts 6 provided on the support base 4 do not move in accordance with the swinging of the seat 2. The left-right cover member 71 swings in the left-right direction in accordance with the movement of the left-right support part 51. Since the foregoing arm insertion holes 76 are provided, a large gap is not unnecessarily formed between the left-right cover member 71 and each of the arm attachment parts 6 and the left-right cover member 71 does not make contact with the arm attachment parts 6.

The front-rear cover member 72 is configured such that the right and left standing side walls 72$a$, the front wall 72$b$, and the back wall 72$c$ standing on the back side are connected in a frame shape in planar view. The front-rear cover member 72 includes a space inside thereof in which the left-right cover member 71 can be housed. The front-rear cover member 72 is attached to the seat support walls 52*c*, and configured so that while the front-rear cover member 72 swings in the left-right direction and the front-rear direction together with the seat support walls 52*c*, the cam surfaces 52*a* and the cam followers 52*b*, both of which are the front-rear support members, are covered and hidden by the side walls 72*a* and the front wall 72*b*. In addition, as illustrated in FIGS. 16, 19 and 20, the front bottom wall 72*b*1 substantially horizontally disposed is provided at the lower end portion of the front wall 72*b*. The front bottom wall 72*b*1 is consistently contactable with a portion of the interpolation cover member 74.

In the second embodiment, each of the right and left side walls 72*a* is not formed in a reversed L-shape as in the first embodiment and is formed in a substantially rectangular shape. Therefore, a small gap is formed between the back wall 72*c* and the left-right cover member 71.

The interpolation cover member 74 is interposed between the left-right cover member 71 and the front-rear cover member 72. Specifically, as illustrated in FIGS. 16, 19 and 20, the interpolation cover member 74 is rotatably engaged though the shaft 74*a* with the upper end on the front side of the cover attachment member 73, therefore being rotatably attached in the front-rear direction.

In addition, in the second embodiment, the plate-shaped back cover member 75 having a curved shape is attached to a rear end portion of the front-rear cover member 72. The back cover member 75 serves to close the gap formed between the back wall 72*c* and the left-right cover member 71.

The left-right cover member 71 does not swing in the front-rear direction, and the front-rear cover member 72 swings in the front-rear direction. Therefore, gaps are provided between the front wall 72*b* of the front-rear cover member 72 and the front ends of the respective side walls 71*a* of the left-right cover member 71, between the back cover member 75 provided adjacent to the back wall 72*c* of the front-rear cover member 72 and the side walls 71*a* of the left-right cover member 71, and between the back cover member 75 and a rear end of the back wall 71*c* of the left-right cover member 71 such that the relative movement between the left-right cover member 71 and the front-rear cover member 72 does not cause interference therebetween.

Thus, the cover member 7 is configured such that the left-right cover member 71 and the front-rear cover member 72 move relatively while coming close to each other with the gaps between the cover members 71, 72.

As just described, the cover members 71, 72 moves following in accordance with the movement of the seat 2, and in addition, can cover the support mechanism 5.

Here, as illustrated in FIGS. 19 and 20, the seat 2 is configured to swing in the front-rear direction in the same way as in the first embodiment. For the front-rear movement as just described of the seat 2, in the same way as illustrated in FIG. 7, the front-rear cover member 72 swings in the front-rear direction in accordance with the front-rear swinging of the front-rear support part 52 configuring the support mechanism 5, but the left-right cover member 71 does not swing in the front-rear direction. However, in the second embodiment, the interpolation cover member 74 configured in the same manner as in the first embodiment is provided at the front end side of the left-right cover member 71 and the back cover member 75 is provided at the rear end side of the left-right cover member 71. Therefore, generation of large gaps between the front end portion of the left-right cover member 71 and the front-rear cover member 72 and between the rear end portion of the left-right cover member 71 and the front-rear cover member 72 is effectively avoided.

Furthermore, at the time of the front-rear movement of the seat 2, inside the front-rear cover member 72, the interpolation cover member 74 rotatably attached to a front end of the cover attachment member 73 rotates around the shaft 74*a* with respect to the left-right cover member 71. In other words, the interpolation cover member 74 rotates around the shaft 74*a* at a base end side contacting to the front bottom wall 72*b*1 of the front-rear cover member 72 with leaning on the front bottom wall 72*b*1 at a tip end. Thus, generation of a gap between a front end portion of the left-right cover member 71 and the front-rear cover member 72 is effectively avoided.

In particular, in the second embodiment, as indicated by solid lines in FIG. 17 and by dashed lines in FIGS. 19 and 20, the back cover member 75 is fixed to the front-rear cover member 72 to be located therein adjacent to the inside rear end of the front-rear cover member 72. In addition, at the time of the front-rear swinging of the seat 2, the back cover member 75 is configured to allow the seat 2 to swing together with the front-rear cover member 72 while securing a slight gap between the back cover member 75 and an upper end portion of the back wall 71*c* of the left-right cover member 71.

Consequently, even when the cover members 71, 72 execute a complex movement to each other, foreign objects are prevented from being trapped between the cover members 71, 72 or between the support base 4 and the cover members 71, 72.

As described above, the chair according to the second embodiment includes the leg 1 provided on the floor surface, the leg support pole 13 provided to stand from the leg 1, and the support base 4 provided on the upper end of the leg support pole 13. The chair includes the movement mechanism 5 located below the seat 2 and provided with the plural movement parts 5A, 5B configured to allow the seat 2 to move in a certain area along a predetermined trajectory in the front-rear direction and left-right direction. The movement mechanism 5 is the support mechanism supports the seat 2 so that the seat 2 moves in the front-rear direction and the left-right direction between the support base 4 and the seat 2. The movement mechanism 5 includes the plural cover members 71, 72 arranged corresponding to the plural movement parts 5A, 5B. The plural cover members 71, 72 move relatively in accordance with the movements of the plural movement parts 5A, 5B, therefore covering the support mechanism 5.

With this configuration, the movement mechanism 5 to move the seat 2 and the backrest 3 includes the plural movement parts 5A, 5B and thus an entire movement range including the respective movement trajectory is increased. Even in such a case, with the configuration described above, the plural cover members 71, 72 are moved relatively in accordance with the movements of the plural movement parts 5A, 5B. Consequently, the individual cover members 71, 72 can be compactly configured and surely cover the movement parts 5A, 5B to hide the movement parts 5A, 5B. In addition, a sitting person can be prevented from interfering with the movement mechanism and the appearance can be preferably maintained.

In particular, the movement mechanism 5 not only moves the seat 2 but also supports the seat 2. Accordingly, the cover members 71, 72 are attached to the movement mechanism 5 and thereby the support portion for the seat 2 can be covered concurrently.

Further, the plural cover members 71, 72 to cover the movement mechanism 5 are configured by a combination of the left-right cover member 71 to move in the left-right direction as one direction and the front-rear cover member 72 to move in the front-rear direction.

In the movement mechanism 5 to move the seat 2 in a two-dimensional surface, the plural cover members 71, 72 are combined to move relatively in two directions perpendicular to each other. In such a case, a configuration substantially not interfering with the movement mechanism 5 can be easily realized without extreme increase of the cover members 71, 72 in size.

Further, the movement mechanism 5 includes the left-right support part 51 configured to support the seat 2 so that the seat 2 moves in the left-right direction, and the front-rear support part 52 configured to support the seat 2 so that the seat 2 moves in the front-rear direction. The plural cover members 71, 72 respectively include the left-right cover member 71 attached to the left-right support part 51, and the front-rear cover member 72 attached to the front-rear support part 52. The left-right cover member 71 and the front-rear cover member 72 are configured to move relatively while coming close to each other with gaps between the cover members 71, 72.

As just described, the movement mechanism 5 includes the front-rear support part 52 and the left-right support part 51, and the left-right cover member 71 is attached to the left-right support part 51 and the front-rear cover member 72 is attached to the front-rear support part 52. Therefore, the cover members 71, 72 are compactly configured and more applicable to the movement parts 5A, 5B. In addition, only gaps are secured between the cover members 71, 72 in the front-rear direction and the left-right direction; therefore, the cover members 71, 72 can be prevented from interfering with the movement mechanism 5. The gaps are set to have appropriate dimensions and thereby foreign objects can be appropriately prevented from entering the gaps between the cover members 71, 72.

Furthermore, an opening in which the connection member 53 to connect the left-right support part 51 to the front-rear support part 52 so that the movement parts move relatively is inserted, is disposed on a facing surface where the left-right cover member 71 is located adjacent to the front-rear cover member 72.

With such a configuration, the left-right movement member on the lower side and the front-rear movement member on the upper side can be connected in the opening by the connection member. In addition, the left-right cover member and the front-rear cover member can be appropriately prevented from interfering with the connection member.

Moreover, the fixation cover member 44 configured to cover the support base 4 and so as not to move in accordance with the movement of the seat 2 is further provided.

As described above, the support base or the like not movable in the front-rear direction and the left-right direction is configured to be covered by the fixation cover member 44, i.e., the movable cover member 7 and the fixation cover member 44 are both applied. With such a configuration, the functions of the respective cover members can be appropriately assigned.

The support base 4 itself may be formed in a shape including the fixation cover member 44. With such a configuration, the fixation cover member 44 can be excluded.

Furthermore, the cover members 71, 72 configuring the chair described above are only prepared; therefore, the safety of the chair can be secured and the preferable appearance thereof can be effectively realized.

In addition, the concrete configuration of each of the components or members is not limited to the foregoing embodiments.

For example, in the foregoing embodiments, the interpolation cover member 74 and the back cover member 75 each interposed between the left-right cover member 71 and the front-rear cover member 72 in the front-rear direction are provided. Alternatively, a different cover member may be further interposed between the front-rear cover member 72 and the left-right cover member 71 in the left-right direction.

At the time of moving the seat and the backrest in the front-rear direction and the left-right direction, the amount of movement or tilt in the front-rear direction is larger than those in the left-right direction. Therefore, the front-rear support part is provided above the left-right support part, and the front-rear cover member is provided above the left-right cover member. Consequently, a stable two-story structure can be established, and the front-rear cover member relatively increasing in size can be arranged as close to a lower surface of the seat as possible. In addition, the interpolation cover member is provided and thereby even when a gap between the left-right cover member and the front-rear cover member varies, the gap is easily closed.

Further, the interpolation cover member is elastically deformable and is attached to one of the left-right cover member or the front-rear cover member or to both of the left-right cover member and the front-rear cover member to slide while coming into contact with the other of the left-right cover member and the front-rear cover member and being elastically deformed. With such a configuration, no gap can be generated between the left-right cover member and the front-rear cover member.

Furthermore, in accordance with the relative movement between the left-right cover member and the front-rear cover member, the interpolation cover member may be configured to relatively move in a different direction from the movement of the left-right cover member and the front-rear cover member.

With such a configuration, even when the left-right cover member and the front-rear cover member move in different directions and thus a gap therebetween varies in a complicated manner, the gap can be appropriately closed by the interpolation cover member.

Also, an elastic cover member elastically deformable in accordance with the movement of the seat may be applied.

As just described, if the elastic cover member is applied in consideration of the movement of the seat, the cover member may be extremely simply configured and attached.

INDUSTRIAL APPLICABILITY

The present invention is applicable to a chair appropriately used in an office or the like and a cover member of the chair.

DESCRIPTION OF REFERENCE NUMERALS

1: leg
13: leg support pole
2: seat
4: support base
5: movement mechanism
5A: movement part (front-rear movement part)
5B: movement part (left-right movement part)
7: cover member
71: left-right cover member
72: front-rear cover member

The invention claimed is:

1. A chair comprising:

a leg arranged on a floor surface;

a leg support pole provided to stand from the leg;

a support base provided on an upper end of the leg support pole;

a movement mechanism located below a seat the movement mechanism including a plurality of movement parts configured to allow the seat to move in a certain area along a predetermined trajectory in a front-rear direction and a left-right direction between the support base and the seat the movement mechanism being a support mechanism configured to support the seat movably in the front-rear direction and the left-right direction: and a plurality of cover members arranged corresponding to the plurality of movement parts, wherein the plurality of cover members is configured to move relatively in accordance with movement of the plurality of movement parts and cover the support mechanism, wherein the movement mechanism includes a left-right support part to support the seat movably in the left-right direction, and a front-rear support part to support the seat movably in the front-rear direction, wherein the plurality of cover members includes a left-right cover member attached to the left-right support part, and a front-rear cover member attached to the front-rear support part, wherein the left-right cover member and the front-rear cover member move relatively while coming close to each other with a gap between the left-right cover member and the front-rear cover member, wherein the front-rear cover member is provided above the left-right cover member, and the chair further comprising an interpolation cover member interposed between the left-right cover member and the front-rear cover member.

2. The chair according to claim 1, wherein the plurality of cover members configured to cover the movement mechanism is formed by a combination of a member to move in a first direction and a member to move in a second direction orthogonal to the first direction.

3. The chair according to claim 1, wherein in accordance with a relative movement between the left-right cover member and the front-rear cover member, the interpolation cover member moves in a different direction from the movement of the left-right cover member and the front-rear cover member.

4. The chair according to claim 1, further comprising a fixation cover member configured to cover the support base and so as not to move in accordance with movement of the seat.

5. The chair according to claim 1, wherein on a facing surface where the left-right movement member is adjacent to the front-rear movement member, an opening for inserting a connection member to relatively and movably connect the left-right movement part to the front-rear movement part so that the movement parts move relatively is disposed.

6. The chair according to claim 5, further comprising a fixation cover member configured to cover the support base and so as not to move in accordance with movement of the seat.

* * * * *